United States Patent [19]

Doane

[11] Patent Number: 5,043,629

[45] Date of Patent: Aug. 27, 1991

[54] SLOTTED DIELECTRIC-LINED WAVEGUIDE COUPLERS AND WINDOWS

[75] Inventor: John L. Doane, La Jolla, Calif.

[73] Assignee: General Atomics, San Diego, Calif.

[21] Appl. No.: 568,410

[22] Filed: Aug. 16, 1990

[51] Int. Cl.[5] ..... H01J 25/00; H01P 1/08; H01P 1/16

[52] U.S. Cl. ..... 315/5; 333/21 R; 333/230; 333/251; 333/252

[58] Field of Search ..... 333/113, 21 R, 230, 333/248, 251, 252; 315/4, 5

[56] References Cited

U.S. PATENT DOCUMENTS

| | | | |
|---|---|---|---|
| 4,523,127 | 6/1985 | Moeller | 315/4 |
| 4,604,551 | 8/1986 | Moeller | 315/4 |
| 4,668,894 | 5/1987 | Barnett et al. | 333/21 R X |
| 4,897,609 | 1/1990 | Mallavarpu | 315/4 X |

FOREIGN PATENT DOCUMENTS

| | | | |
|---|---|---|---|
| 2543368 | 9/1984 | France | 333/21 R |
| 986494 | 3/1965 | United Kingdom | 333/252 |

OTHER PUBLICATIONS

H. G. Unger, "Lined Waveguide", *Bell System Tech. J.*, 41:745–768 (1962).

Carlin et al., "Normal Modes in Overmoded Dielectric-Lined Circular Waveguide", *Bell System Tech. J.*, 52:453–486 (1973).

J. L. Doane, "Wave Conversion in Stratified Media with Hyperbolic-Tangent Nonuniformities", *J. Appl. Phys.*, 45:2748 (1974).

Vlasov et al., "Transformation of a Whispering Gallery Mode, Propagating in a Circular Waveguide, into a Beam of Waves", *Radio Engineering and Electronic Physics*, 20:14–17 (1975).

R. B. Smith, "Analytic Solutions for Linearly Tapered Directional Couplers", *J. Opt. Soc. Am.* 66:882 (1976).

C. Dragone, "Reflection, Transmission, and Mode Conversion in a Corrugated Feed", *Bell System Tech. J.*, 56:835–867 (1977).

C. Dragone, "High-Frequency Behavior of Waveguides with Finite Surface Impedances", *Bell System Tech. J.* 60:89–115 (1981).

J. L. Doane, "Mode Converters for Generating the $HE_{11}$ (Gaussian-Like) Mode from $TE_{01}$ in a Circular Waveguide", *Int'l J. Electronics* 6:573–585 (1982).

Moeller et al., "Electron Cyclotron Heating Experiments on the JFT-2 Tokamak Using an Inside Launch Antenna", *Phys. Fluids*, 25:1211 (1982).

C. P. Moeller, "Mode Converters used in the Doublet III ECH microwave system", *Int'l J. Electronics*, 53:587–593 (1982).

J. L. Doane, "Parabolic Tapers for Overmoded Waveguides", *Int'l J. Infrared and Millimeter Waves*, 5:737–751 (1984).

M. N. Afsar, "Dielectric Measurements of Millimeter-Wave Materials", *IEEE Trans. Microwave Theory Tech.*, 32: 1598–1609 (1984).

M. Thumm, "Computer-Aided Analysis and Design of Corrugated $TE_{11}$ to $HE_{11}$ Mode Converters in Highly (List continued on next page.)

*Primary Examiner*—Paul Gensler

*Attorney, Agent, or Firm*—Fitch, Even, Tabin & Flannery

[57] ABSTRACT

Dielectric-filled longitudinal slots in the common wall of concentric circular and coaxial dielectric-lined waveguides allow microwave energy to be efficiently coupled therethrough. Such couplers are used with megawatt level gyrotrons for varied applications. One application provides a double seal waveguide vacuum window with low reflections over a wideband of frequencies. Another application provides an output coupler and window for quasi-optical gyrotrons. Still another application provides a waveguide mode converter for converting high order microwave modes, as are commonly found in waveguide cavities of high power gyrotrons, to lower-order modes suitable for low-loss transmission, such as the $HE_{11}$ mode.

39 Claims, 8 Drawing Sheets

OTHER PUBLICATIONS

Overmoded Waveguides", *Int'l Infrared and Millimeter Waves,* 6:577–597 (1985).

J. L. Doane, "Propagation and Mode Coupling in Corrugated and Smooth-Wall Circular Waveguides", Chapter 5 in *Infrared and Millimeter Waves,* 13: K. J. Button, ed., Academic Press (1985).

Lee et al., "Normal Modes in an Overmoded Circular Waveguide Coated with Lossy Material", *IEEE Trans. Microwave Theory Tech.,* 34:773–785 (1986).

R. O. Dendy, "Linear Mode Conversion and the Operator Theory of Wave Mechanics", *Phys. Fluids, 31:298 (1988).*

R. O. Dendy, "Resonant Interval Action Transfer Between Coupled Harmonic Oscillators", *J. Math. Phys.* (1988).

Thumm et al., "In-Waveguide TE01-to-Whispering Gallery Mode Conversion Using Periodic Wall Perturbations", *Proc. 13th Int'l Conf. Infrared and Millimeter Waves.* Hawaii, Dec. (1988).

Casey et al., "A Mode Converter for Whispering Gallery Mode Gyrotrons", *Bull A.P.S.* 34:2091 (1989).

C. F. Lewis, "Complex Coatings with CVD", *Materials Engineering,* 35–38 (1989).

Fliflet et al., "Design and Operating Characteristics of a CW Relevant Quasi-Optical Gyrotron with Variable Mirror Separation", *NRL Memorandum Report* 6459, Naval Research Laboratory, Jun. 26, 1989.

NORMALIZED LONGITUDINAL PROPAGATION CONSTANTS AT 110 GHz IN 1.25-INCH DIAMETER CIRCULAR WAVEGUIDE LINED WITH ALUMINA ($\epsilon_r$ = 9.6)

LINING THICKNESS ON INNER CONDUCTOR OF COAXIAL WAVEGUIDE, OUTER CONDUCTOR DIA.=2.0"; INNER CONDUCTOR DIA.= 1.543"

SLOTTED DIELECTRIC-LINED WAVEGUIDE COUPLERS AND WINDOWS

BACKGROUND OF THE INVENTION

The present invention relates generally to the transfer of microwave energy, and more particularly to the coupling of microwave energy through dielectric filled longitudinal slots in the common wall of concentric circular and coaxial dielectric-lined waveguides. The invention has particular application to microwaves of very high power, as might be used with megawatt level gyrotrons.

Waveguides are a form of transmission line used to transmit electromagnetic energy efficiently from one point to another. Waveguides may be rectangular, circular or coaxial. The type of waveguide that is best suited for a particular application depends upon how the microwave energy is being used. If it is being coupled from a source of microwave energy, e.g., a gyrotron, one type of waveguide may be more efficient (i.e., couple the energy with less loss) than another type of waveguide. If it is being transmitted over relatively long distances, another type of waveguide may be more efficient. If it is being delivered to a load, still another type of waveguide may be more efficient. Hence, there is a recurring need for waveguide couplers that efficiently couple microwave energy from one type of waveguide, e.g., coaxial, to another type of waveguide, e.g., circular.

Waveguide modes are denominated to identify the distribution of the electric and magnetic fields within the waveguide. As indicated in the art, e.g., *Electronics Designers' Handbook,* 24 Edition (McGraw-Hill 1977) at page 8–36; or Marcuvitz, N., *Waveguide Handbook,* McGraw-Hill, pp. 72–80 (1951), specific modes are indicated by symbols such as $TE_{mn}$ and $TM_{mn}$. TM indicates that the magnetic field is everywhere transverse to the axis of the transmission line, i.e., the longitudinal axis of the waveguide. TE indicates that the electric field is everywhere transverse to the axis of the waveguide. For rectangular waveguides, the subscripts m and n denote the number of half period variations of the fields occurring within the waveguide in the two transverse dimensions. For circular waveguides, the subscript m denotes the number of full-period variations of the transverse component of the field in the angular direction, and is frequently referred to as the angular mode number, while the subscript n denotes the number of half-period variations of the transverse component of the field in the radial direction. A circular waveguide mode having no angular dependence may thus be either a $TE_{0n}$ or a $TM_{0n}$ mode, where n is any integer.

A common waveguide mode useful with the new generation of millimeter wavelength gyrotrons, having, e.g., output frequencies greater than 100 GHz and output power greater than 500 kW, is the hybrid $HE_{11}$ mode. The $HE_{11}$ mode, for purposes of this application, may be regarded as a superposition of a conventional TE mode and a conventional TM mode that exists only in certain types of waveguides, e.g., corrugated waveguides. See, e.g., C. Dragone, "High-Frequency Behavior of Waveguides with Finite Surface Impedances", *Bell System Tech J.* 60: 89–116 (1981).

As shown hereinafter, another type of waveguide that supports the hybrid modes is a dielectric-lined circular waveguide.

Unlike other waveguide modes, microwave energy propagating in the $HE_{11}$ mode couples well to free space waves after the waveguide terminates. Hence, the $HE_{11}$ mode is highly desirable for applications, such as communications or plasma heating, that require the microwave energy to be used outside of the waveguide and focused or otherwise directed to a desired target or zone. Unfortunately, the output power available from most high power gyrotrons, including the quasi-optic gyrotrons, is not available in the $HE_{11}$ mode. Hence, there is a need for, microwave waveguide mode converters that efficiently convert microwave energy from whatever mode is available at a source of the microwave energy to a mode more useful for a desired application.

Frequently, the coupling of microwave energy from one location to another, e.g., from a first waveguide to a second waveguide, must be achieved while maintaining an appropriate seal between the coupled locations. Waveguide windows are used to permit power to pass from one waveguide to a second waveguide, while maintaining a physical barrier between the two waveguides. The seal or physical barrier is required because, e.g., the waveguides may contain different gases or have different pressure levels, and one or both waveguides may be evacuated. Moreover, in high power microwave vacuum devices, such as gyrotrons and the like, power is generally transferred between an evacuated chamber or waveguide in the device and a waveguide having a gaseous environment. One or more waveguide windows may thus be used to provide a hermetic seal between the two media.

In addition to requiring a window at a gyrotron output, a window may also be needed near a destination site of the microwave power, i.e., at the load, to provide a suitable barrier or shield from undesirable elements at the destination site. For example, where the destination site includes a plasma device, a significant amount of tritium may be present. Thus, even if the transmission line from the gyrotron is evacuated, a window may be needed to serve as a tritium barrier.

An output window used within a gyrotron must also frequently be coupled to a suitable collector that absorbs the electron beam utilized in such devices. Unfortunately, existing collectors used within gyrotrons have low microwave loss and low mode conversion, which compromises their design as electron beam dumps.

From the above, it is evident that there is a need in the art for a microwave coupler, window and converter device that may be used, e.g., with a high power gyrotron to efficiently couple the output power of the gyrotron through a window barrier to an output waveguide, while at the same time converting the waveguide mode of the microwave energy in the output waveguide to a desired waveguide mode. The present invention advantageously addresses these and other needs.

SUMMARY OF THE INVENTION

The present invention provides a basic waveguide apparatus that efficiently performs coupling, windowing and/or mode converting functions. The basic waveguide apparatus includes concentric circular and coaxial waveguides, with a region of overlap. An array of equally spaced longitudinal slots is placed in the common wall separating the waveguides in the region of overlap. The slots are filled with a suitable dielectric. In addition, the common wall is lined on both sides with a dielectric. The thickness of the dielectric, as well as the width of the slots, is controlled so as to optimize coupling to desired modes.

In accordance with a primary aspect of the invention, microwave energy is coupled between the circular and coaxial waveguides through the dielectric-filled longitudinal slots. The thickness of the dielectric lining on the common wall separating the concentric waveguides is tapered, as required, in order to control the mode of propagation of the microwave energy. Advantageously, the dielectric-filled slots serve as a seal that places a physical barrier between one waveguide and the other, thereby allowing the basic coupling structure to further function as a microwave window.

Variations of the basic microwave waveguide apparatus in accordance with the present invention (i.e., concentric circular and coaxial dielectric-lined waveguides with dielectric-filled longitudinal slots in the common wall) find primary applicability for use with megawatt gyrotrons.

Embodiments of the invention may be used, e.g., as: (1) a waveguide vacuum window with low reflections over a wideband of frequencies; (2) an output coupler and window for quasi-optical gyrotrons having output power diffracted around a cavity mirror; and (3) waveguide mode converters for converting high order microwave modes, as are commonly found in waveguide cavities of high power gyrotrons, to lower-order modes suitable for low-loss transmission, such as the $HE_{11}$ mode.

One embodiment of the invention may thus be characterized as a waveguide coupling apparatus. Such an apparatus converts microwave energy in a circular waveguide propagating in a first mode, e.g., the $HE_{11}$ mode, to a suitable coaxial waveguide mode. The apparatus includes: (a) a circular waveguide; (b) a coaxial waveguide concentric with the circular waveguide and overlapping a portion of the circular waveguide, with a common wall separating the circular waveguide from the coaxial waveguide, and with this common wall comprising an outer wall of the circular waveguide and an inner wall of the coaxial waveguide in the portion of overlap; (c) means for coupling the microwave energy in the circular waveguide to a corresponding mode in the coaxial waveguide, this coupling means including an array of N equally spaced axial slots placed in the common wall, where N is an integer, and where the slots are filled with a dielectric; and (d) a dielectric lining on both sides of the common wall in the portion of overlap, where the respective thicknesses of the dielectric lining on each side of the common wall are varied along the length of the slots to cause a crossover in the phase velocities of the microwave energy propagating in the respective waveguides. The invention also includes means for transforming the $HE_{11}$ mode to a desired $EH_{11}$ mode in the dielectric-lined portion at the beginning of the slots. This transforming means acts to transform the phase velocity of the microwave energy and may comprise, for example, a corrugated circular waveguide with a variable corrugation depth.

Another embodiment of the invention may be characterized as waveguide window apparatus. Such window apparatus includes: (a) first waveguide coupling means for coupling microwave energy from a first circular waveguide to a coaxial waveguide; (b) second waveguide coupling means for coupling microwave energy from the coaxial waveguide to a second circular waveguide; (c) sealing means for creating a pressure tight seal between the first and second circular waveguides, and also between these circular waveguides and the coaxial waveguide; and (d) absorbing means for preventing reflections of unwanted modes within the circular or coaxial waveguides.

Still a further embodiment of the invention comprises waveguide mode converter apparatus. Such converter apparatus essentially includes a first coupling apparatus, as above described, overlapping a second coupling apparatus. The first coupling apparatus includes an output circular waveguide overlapping the output end of an intermediate coaxial waveguide. The second coupling apparatus includes an input coaxial waveguide overlapping the input end of the intermediate coaxial waveguide. Microwave energy propagating in a first mode in the input coaxial waveguide is coupled through axial slots to the input end of the intermediate coaxial waveguide. Microwave energy coupled to the intermediate coaxial waveguide is then coupled through dielectric-filled axial slots, at the output end of the intermediate coaxial waveguide, to the output circular waveguide. The energy in the intermediate coaxial waveguide propagates in a second mode. Hence, the microwave energy is converted between the first and second coaxial waveguide modes and then to the circular waveguide $HE_{11}$ mode. As needed or desired for a particular application, the input coaxial waveguide may be connected to an input circular waveguide, by tapering out the center conductor in the input coaxial waveguide.

The waveguide mode converter apparatus described above (including overlapping first and second coupling apparatus) may be more particularly described as comprising: (a) a circular waveguide adapted to propagate microwave energy in an output waveguide mode; (b) an intermediate coaxial waveguide concentric with the circular waveguide and overlapping the circular waveguide, there being a first common wall separating the circular waveguide from the intermediate coaxial waveguide; (c) first coupling means for coupling microwave energy propagating in the intermediate coaxial waveguide to an output waveguide mode in the circular waveguide, this first coupling means including an array of N equally spaced dielectric-filled axial slots placed in the first common wall in the first portion of overlap; (d) a coaxial waveguide extension connected to the intermediate coaxial waveguide, an inner wall of this coaxial waveguide extension comprising an extension of the first common wall; (e) an input coaxial waveguide overlapping a second portion of the coaxial waveguide extension, there being a second common wall separating the coaxial waveguide extension from the input coaxial waveguide; (f) second coupling means for coupling microwave energy propagating in an input waveguide mode in the input coaxial waveguide to the intermediate coaxial waveguide, this second coupling means including an array of M equally spaced axial slots placed in the second common wall in the second portion of overlap; and (g) means for separating TE and TM modes of microwave energy propagating through the mode converter apparatus, such as a dielectric lining or corrugations on an inner conductor of the intermediate coaxial waveguide in the second region of overlap.

It is a feature of the present invention to provide a circular-to-coaxial waveguide coupling apparatus that efficiently transfers microwave energy between circular and coaxial waveguides, i.e., that transfers microwave energy at low ohmic loss and low spurious mode generation.

It is another feature of the invention to provide such a waveguide coupling apparatus that also converts and controls the mode in which the microwave energy propagates.

It is also a feature of the invention to provide such a waveguide coupling apparatus wherein the mode in which the microwave energy propagates is controlled, at least in part, by controlling the thickness of a dielectric lining on both sides of the common wall separating the circular and coaxial waveguides.

It is a further feature of the invention to provide such a waveguide coupling apparatus that also physically seals the circular and coaxial waveguides from each other, thereby preserving desired conditions, e.g., the presence of certain gases or pressure, in one or both waveguides.

It is an additional feature of the invention to provide a basic microwave coupling structure that is relatively easy and inexpensive to manufacture, and that lends itself to a wide variety of high power microwave coupling, windowing, and mode conversion applications, including coupling high power microwave energy from a gyrotron.

BRIEF DESCRIPTION OF THE DRAWINGS

The above and other aspects, features and advantages of the present invention will be more apparent from the following more particular description thereof, presented in conjunction with the following drawings wherein:

FIG. 10 schematically depicts a cross section of a coupler made in accordance with the invention further including cooling channels longitudinally inserted in the common wall separating the circular waveguide from the coaxial waveguide.

DETAILED DESCRIPTION OF THE INVENTION

The following description is of the best mode presently contemplated for carrying out the invention. This description is not to be taken in a limiting sense, but is made merely for the purpose of describing the general principles of the invention. The scope of the invention should be determined with reference to the claims.

Figures 1A, 1B, 1C:
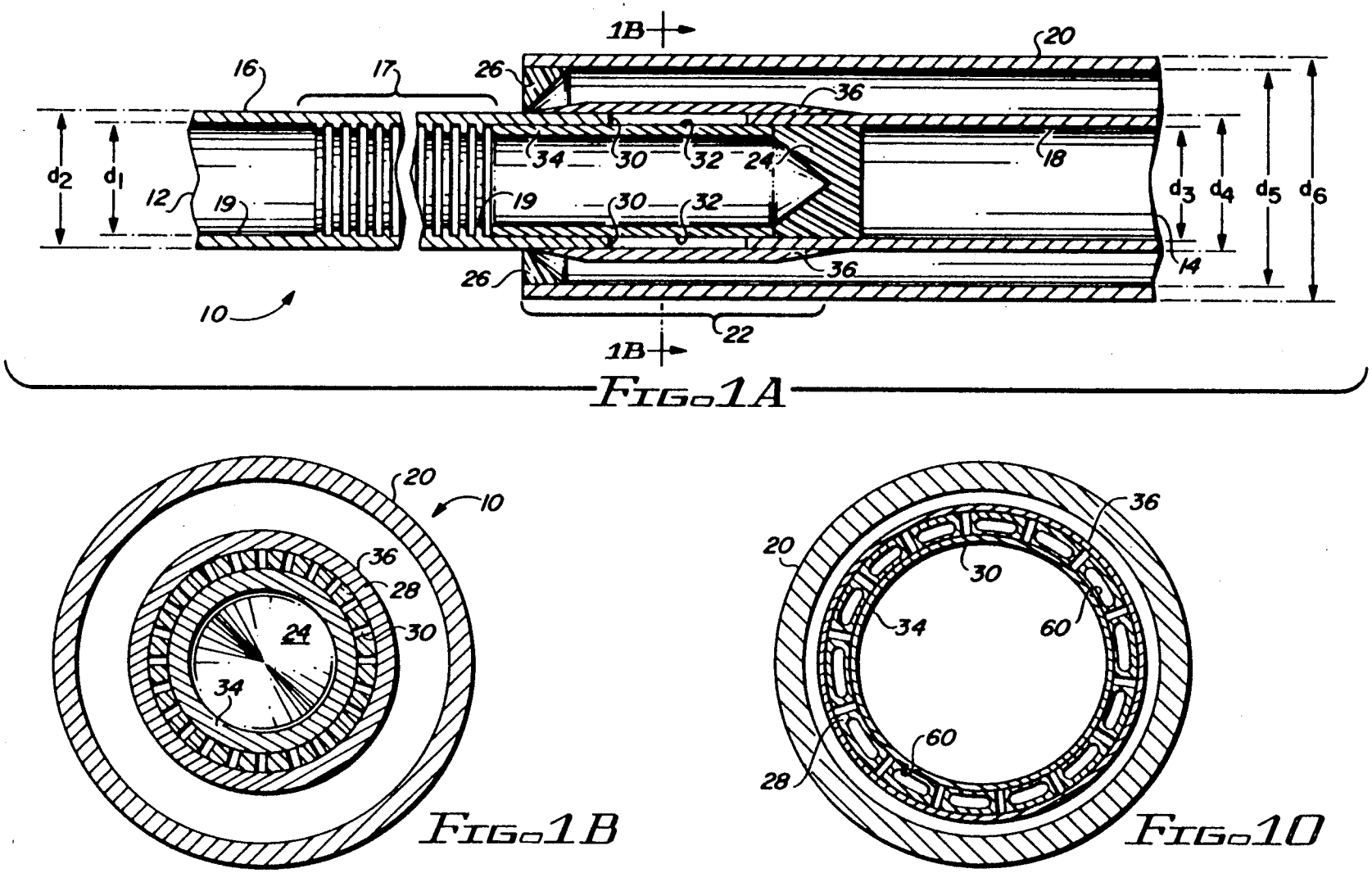
FIG. 1A schematically shows a side view of the basic coupling structure of the present invention, including an array of longitudinal slots in a common wall separating the circular waveguide from the coaxial waveguide, and a dielectric lining on both sides of the common wall.
FIG. 1B schematically shows a sectional view taken along the line 1B–1B of FIG. 1A.

A basic coupling structure 10 made in accordance with the present invention is shown schematically in FIGS. 1A and 1B. FIG. 1A is a side view and FIG. 1B is a sectional view taken along the line 1B—1B of FIG. 1A. The structure 10 includes a circular waveguide 12 and a coaxial waveguide 14. The circular waveguide 12 has a single cylindrical wall 16 having an inside diameter $d_1$ and an outside diameter $d_2$. The coaxial waveguide 14 includes an inner cylindrical wall 18 and an outer cylindrical wall 20. The inner cylindrical wall has inside and outside diameters of $d_3$ and $d_4$, respectively. The outer cylindrical wall has inside and outside diameters of $d_5$ and $d_6$, respectively. In accordance with standard waveguide convention, the inner cylindrical wall 18 is often referred to as the "inner conductor" and the outer cylindrical wall 20 is often referred to as the "outer conductor". In a preferred embodiment, the dimensions of the cylindrical wall 16 of the circular waveguide 12 are the same as the dimensions of the inner conductor (cylindrical wall) 18 of the coaxial waveguide 14. That is, $d_1=d_3$, and $d_2=d_4$.

It is convenient to view the coupling structure 10 as a coaxial waveguide having an outer conductor that has been extended to overlap a portion of an adjoining circular waveguide. The overlap portion or region (or extended outer conductor) is identified in FIG. 1A with the reference numeral 22. A common wall 28 separates the coaxial waveguide 14 from the circular waveguide 12 in the region of overlap 22. In accordance with the present invention, a suitable energy absorbing material 24 is placed in the end of the circular waveguide 12. This absorbing material 24 effectively closes off the circular waveguide 12. Similarly, additional energy absorbing material 26 is placed at the end of the overlap region 22 to seal the coaxial waveguide 14 and prevent microwave energy from exiting the coaxial waveguide at this sealed end. The absorbing materials 24 and 26, as explained more fully below, further serve to prevent undesired reflections within their respective waveguides.

Coupling of microwave energy occurs between the circular waveguide 12 and the coaxial waveguide 14 through an array of N equally spaced axial slots 30 placed through the common wall 28. These slots are shown best in the sectional view of FIG. 1B. In accordance with an important feature of the invention, these slots are filled with a suitable dielectric material 32, such as alumina ($Al_2O_3$). Further, a thin dielectric lining 34 and 36 is placed on both the inside and the outside, respectively, of the common wall 28 in the region of overlap. The dielectric-filled slots function as a physical barrier, or seal, thereby allowing the coupler device 10 to also function as a window. The dielectric-filled slots, in combination with the dielectric linings 34 and 36, as explained more fully below, control the longitudinal propagation constant $\beta$ of the coupled microwave energy, thereby helping to maintain a desired mode of the microwave energy in each waveguide.

Further, as described more fully below, for many applications it is desirable that a corrugated circular waveguide section 17 be used as a transition between the smooth circular waveguide 12 and that portion of the waveguide containing the thin dielectric lining 34. Such section 17 contains annular corrugations 19 of increasing depth, and serves to convert an $HE_{11}$ mode in the smooth circular waveguide to an $EH_{11}$ mode in the dielectric lined circular waveguide.

Figure 2:
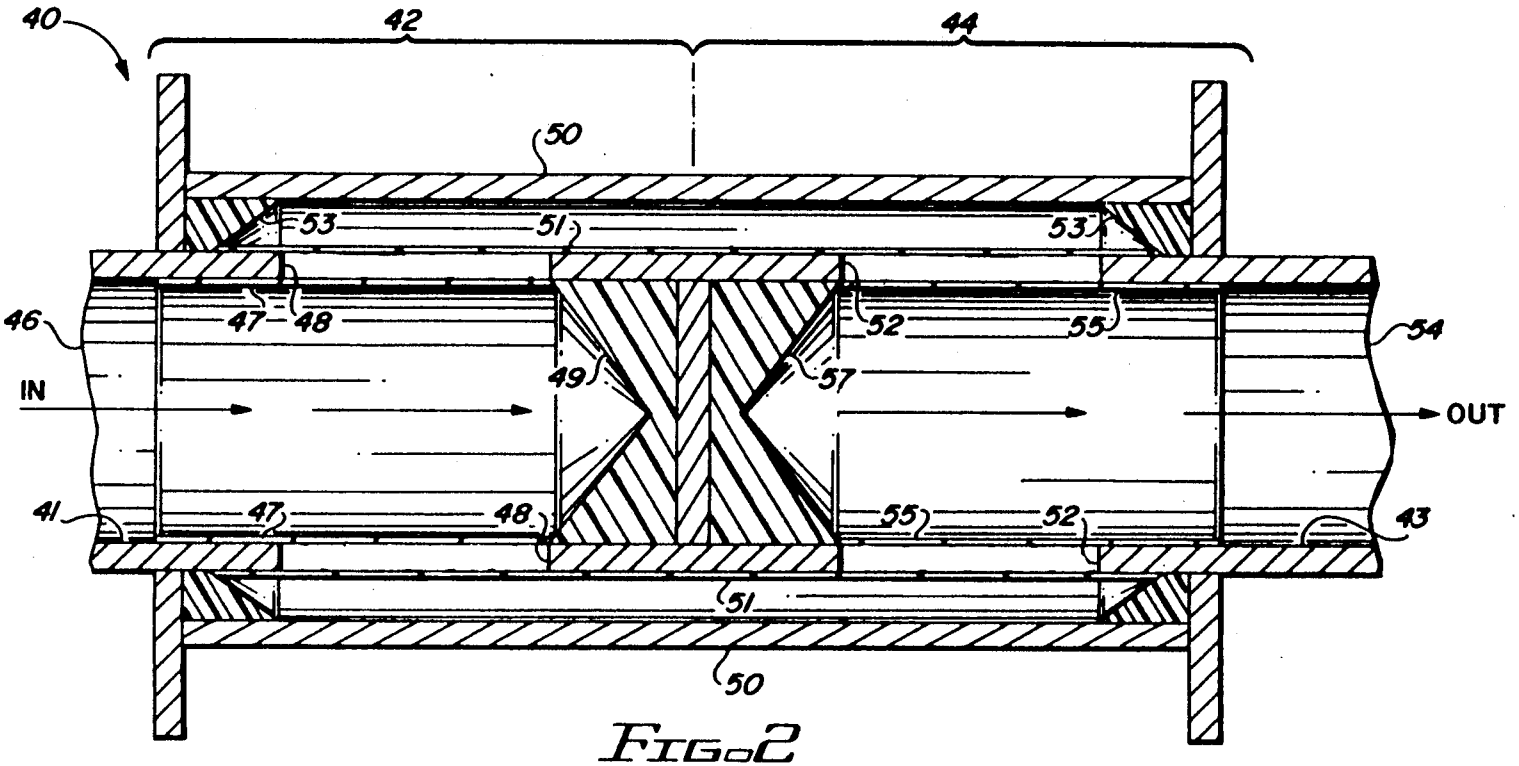
FIG. 2 schematically illustrates a high power microwave window structure made in accordance with the present invention that provides a double seal.
Figure 3:
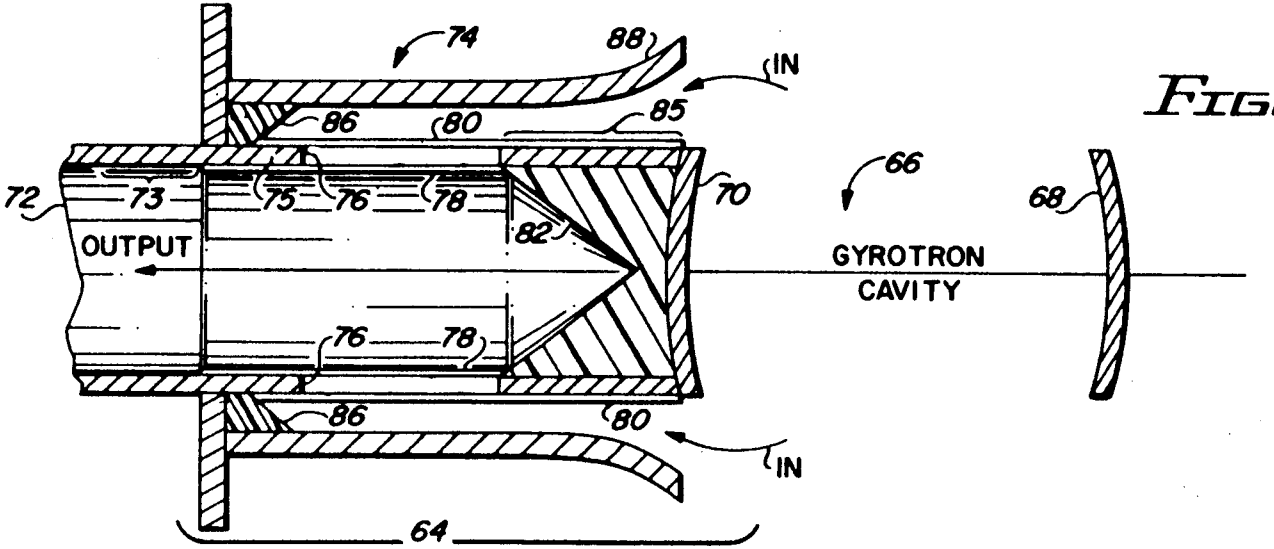
FIG. 3 is a schematic side view of an output coupler for a quasi-optic gyrotron.
Figure 4:
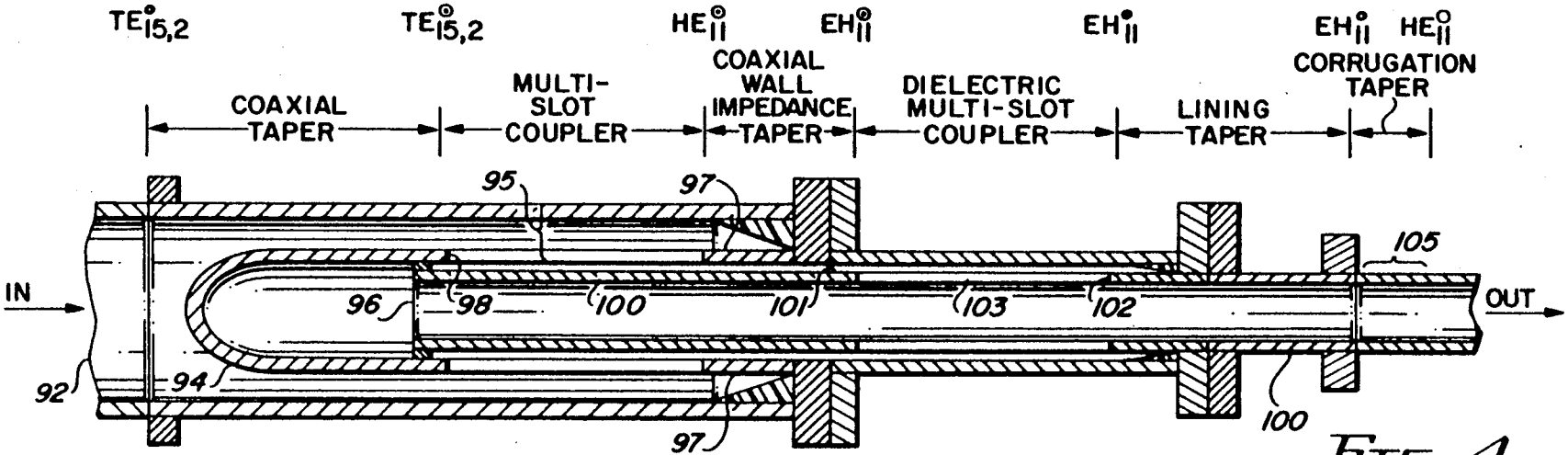
FIG. 4 is a schematic side view of a mode converter that converts, for example, a whispering gallery mode (generated, e.g., by a gyrotron) to a circular $HE_{11}$ mode.
Figure 5:
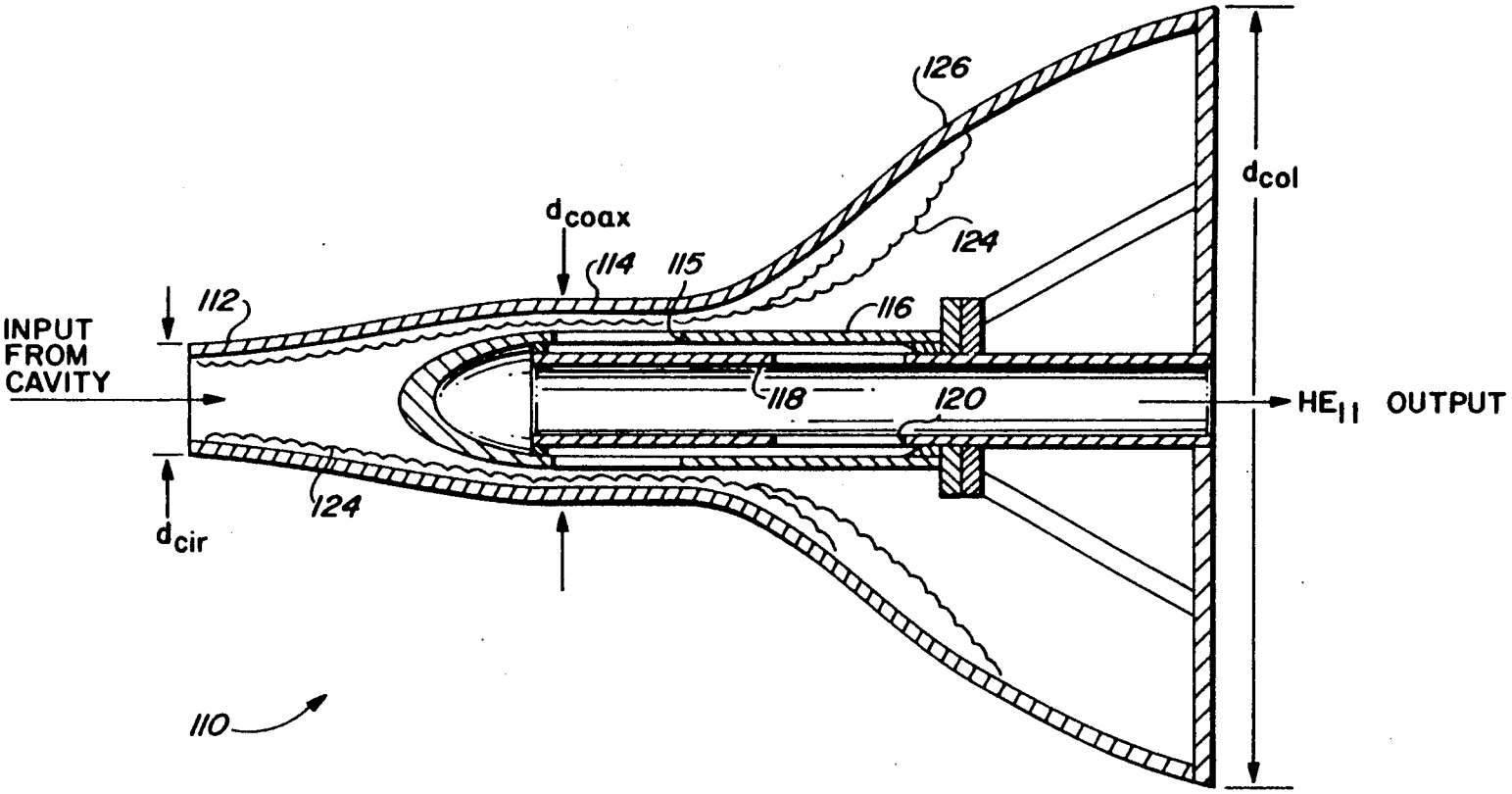
FIG. 5 is a schematic side view of a mode converter adapted for use inside of a gyrotron, including means for microwave/electron beam separation and a vacuum window.

Utilizing variations of the basic coupling device 10, the present invention advantageously performs numerous functions. For example, as shown in FIG. 2, a transmission line window 40 is realized by essentially placing two couplers 42 and 44 (each being essentially as described in FIG. 1) back-to-back. As shown in FIG. 3, a variation of the basic coupler structure is used to couple output power from a quasi-optical gyrotron to the $HE_{11}$ mode in a circular waveguide. As shown in FIG. 4, the basic coupler structure is used as a mode converter to convert the high power and high order output modes commonly provided by gyrotrons, such as whispering gallery modes, to the circular waveguide $HE_{11}$ mode. If used inside of a gyrotron, the outer coaxial region of the mode converter structure may also serve as a microwave/electron beam separator, while the interior region may serve as a vacuum window, as shown in FIG. 5. Before describing these variations in more detail, however, it will first be helpful to review some basic principles associated with the transfer and coupling of microwave energy through and between waveguide structures.

Figure 6:
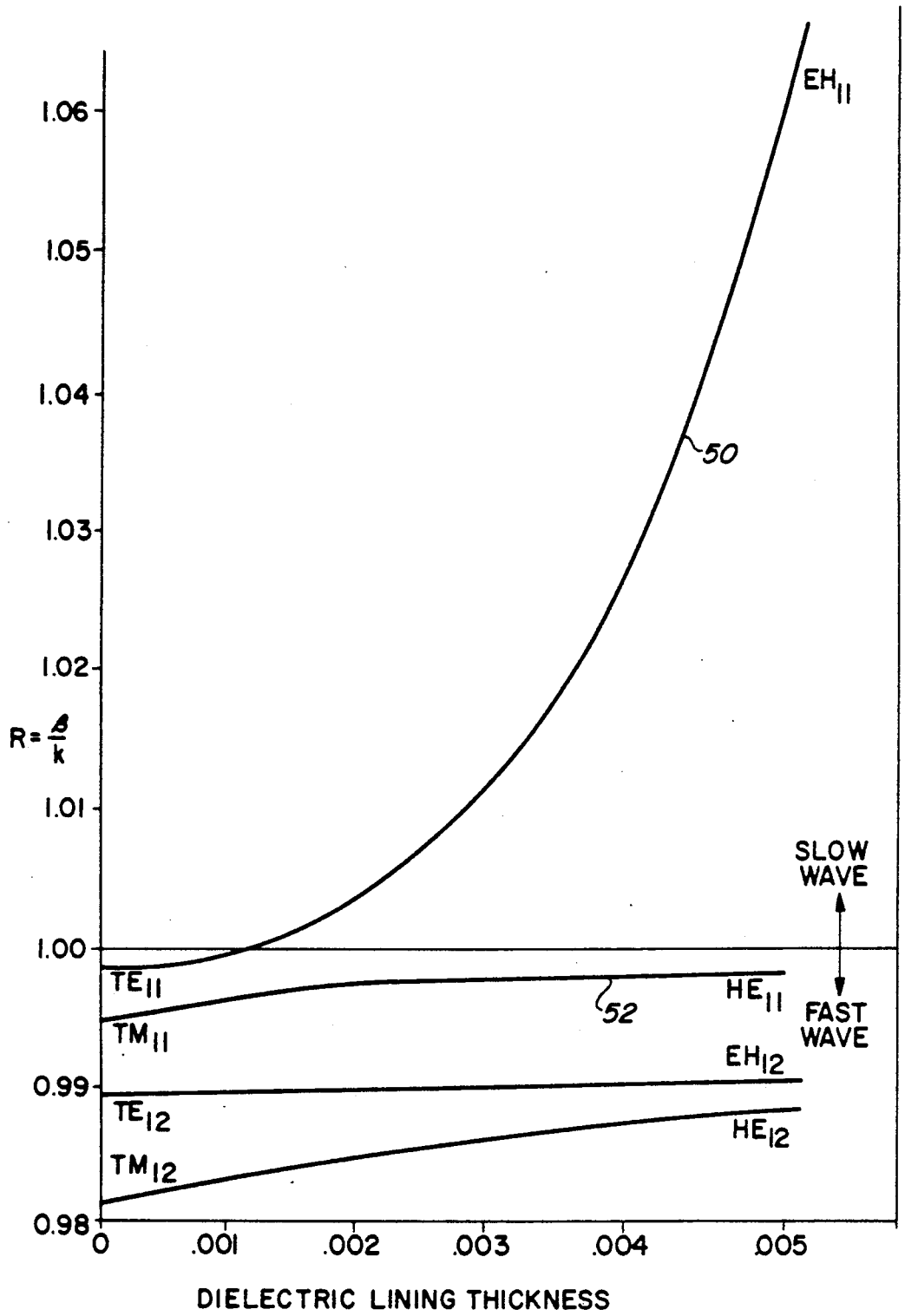
FIG. 6 is a graph illustrating normalized propagation constants for various circular waveguide modes as a function of the thickness of a dielectric lining within the waveguide.

A key feature of the basic coupling structure shown in FIGS. 1A and 1B is the use of the dielectric lining 34 and 36 on both sides of the common wall 28. The dielectric lining serves the primary function of controlling the longitudinal propagation constant $\beta$ of the propagating microwave energy, and thus serves the same function as do corrugations in a corrugated waveguide. (It is noted that a corrugated waveguide having a tapered corrugation depth may be used in lieu of a tapered dielectric lining thickness for purposes of the present invention, except in the regions where the waveguide wall is slotted.) Significantly, as is known in the art, the propagation constant $\beta$ varies as a function of the thickness of the dielectric lining. Further, the variation of $\beta$ differs depending upon the particular propagation mode. FIG. 6 graphically illustrates how the normalized propagation constant R varies as a function of lining thickness in a 1.25-inch diameter circular waveguide lined with alumina. The normalized propagation constant R is equal to $\beta/k$, where k is the free space propagation constant. The plot shown in FIG. 6 is based on the derivation of the characteristic equation for $\beta$, which derivation is described in the art. See, e.g., H. G. Unger, "Lined Waveguide," *Bell System Tech. J.* 41, 745–768 (1962); and J. W. Carlin and P. D'Agostino, "Normal Modes in Overmoded Dielectric-Lined Circular Waveguide," *Bell System Tech. J.* 52, 453–486 (1973).

Figure 7:
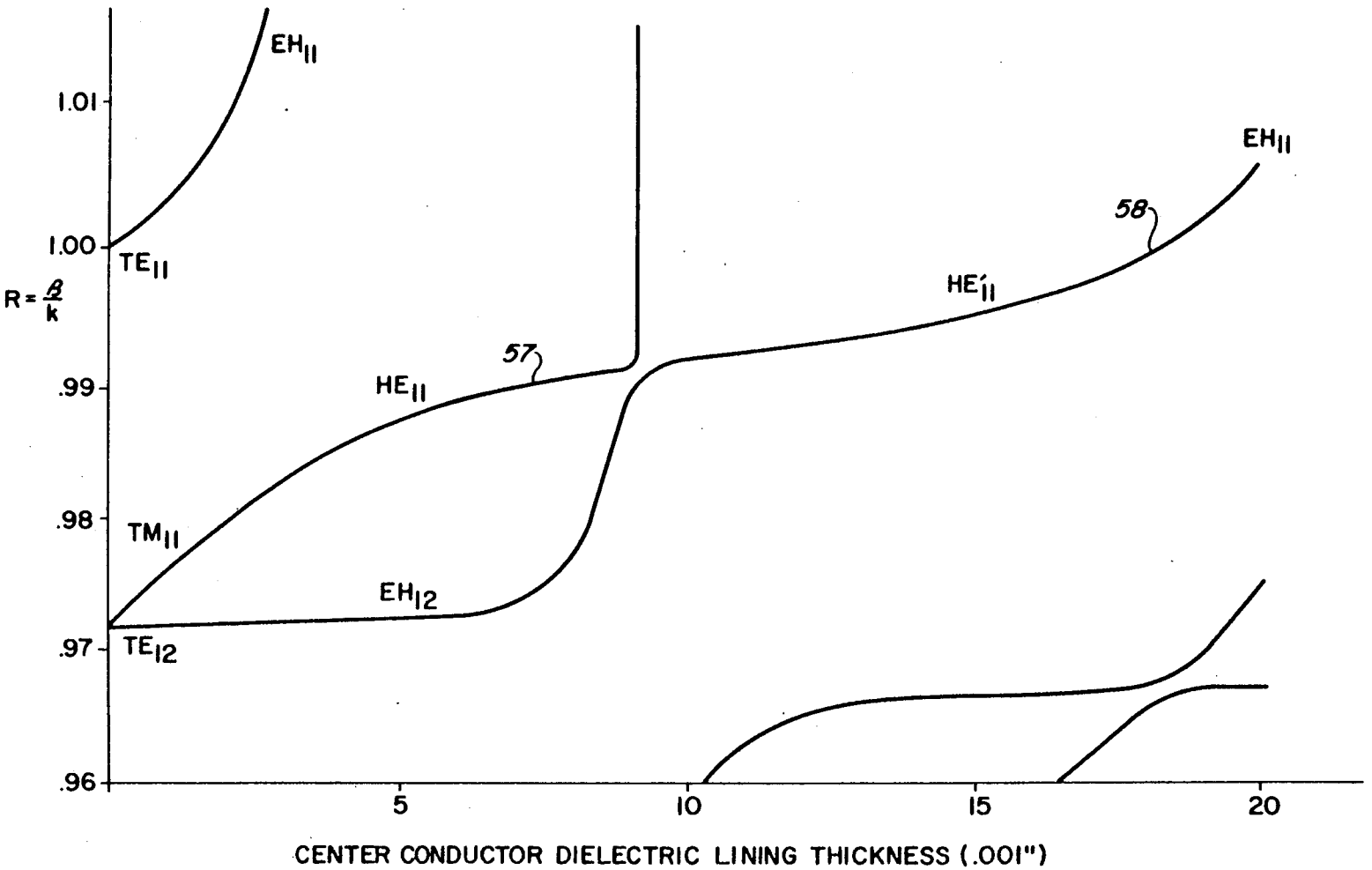
FIG. 7 is a graph similar to FIG. 6 for various coaxial waveguide modes.

FIG. 7 is a graph similar to FIG. 6 (and derived using the same approach as was the graph of FIG. 6), but for a coaxial waveguide having a 1.543 inch outer diameter for the center conductor and a 2.00 inch inner diameter for the outer conductor.

It is noted that a preferred dielectric material for use as the dielectric lining for both the circular and coaxial waveguides is alumina. This is because alumina exhibits low microwave loss. That is, the dielectric constant and loss tangent of 99.5% pure (WESGO) alumina are 9.6 and 0.0006, respectively, at 110 GHz. See, M. N. Asfar, "Dielectric Measurements of Millimeter-Wave Materials," *IEEE Trans. Microwave Theory Tech.* 32, 1598–1609 (1984). Other equivalent, or approximately equivalent, materials may, of course, also be used. Advantageously, alumina may be deposited on either the inner or outer surfaces of the microwave tubing using commercially known chemical vapor deposition (CVD) processes, such as described in C. F. Lewis, "Complex Coatings with CVD," *Materials Engineering*, 35–38, (1989). Such alumina can be advantageously deposited on molybdenum tubing, because molybdenum has a high melting point, and also has a close match to the temperature coefficient of thermal expansion of alumina. To minimize the microwave loss, the molybdenum may first be coated with copper. It is noted that some metal oxides used as a dielectric exhibit high microwave loss, and hence should be avoided. Further, care must be exercised to prevent any such oxides from forming on the metal surfaces of the waveguide that carry microwave currents.

When a dielectric lining is introduced on a circular waveguide wall, all modes with nonzero azimuthal variation ($m \neq 0$) become hybrid modes. That is, these modes all have both electrical ($E_z$) and magnetic ($H_z$) field components in the longitudinal direction (z) of the waveguide structure. Thus, $TM_{mn}$ modes become $HE_{mn}$ modes, with fields concentrated towards the center of the waveguide. $TE_{mn}$ modes become $EH_{mn}$ modes. Except for $n=1$ modes, the fields of the EH modes are pushed away from the dielectric liner the same as the HE modes.

As shown in FIG. 6, as the lining thickness increases, the longitudinal propagation constant $\beta$ of all the modes also increases (although the individual variations or rate of increase for each mode differs significantly). Consequently, the phase velocity $\omega/\beta$ correspondingly decreases. This decrease in phase velocity reflects the fact that as the thickness of the dielectric lining increases, a small amount of field is drawn into the dielectric, wherein the propagation velocity is less than in free space.

With reference to the curve labeled 50 in FIG. 6, for example, corresponding to the $EH_{11}$ mode (and the $EH_{m1}$ modes in general), as the liner thickness increases, $\beta$ quickly becomes larger than k, and the mode becomes a slow wave for small lining thicknesses. Because the fields are rapidly drawn into the liner, the mode also becomes a surface mode. The fields then decay exponentially away from the liner.

In contrast, as seen with reference to the curve labeled 52 in FIG. 6, corresponding to the $HE_{11}$ mode, it is seen that the propagation constant varies little over a large range of dielectric thickness. Over the range from 0.002 to 0.005 inches, for example, $\beta$ varies by less than 0.1% for the particular parameter values utilized in deriving FIG. 6. The ratio of the TE and TM components also remains close to unity in magnitude over this range. Hence, the field structure in the air-filled region is virtually identical to that of the $HE_{11}$ mode in corrugated waveguide. See, e.g., C. Dragone, "High-Frequency Behavior of Waveguides with Finite Surface Impedances," *Bell System Tech. J.* 60, 89–115 (1981).

For this mode, the tangential magnetic fields are small near the wall. Correspondingly, the ohmic wall losses (in copper) are less than 0.02 dB per foot over this wide range of dielectric thicknesses.

In order to achieve sufficient coupling through slots in the circular waveguide wall, it is desirable for a mode to be somewhat sensitive to the dielectric lining thickness, but not overly sensitive. Further, to avoid unwanted mode conversion, the desired $m=1$ mode should be separated as far as possible in $\beta$ from the other $m=1$ modes.

It can be shown that the mode with the largest coupling and best separation is the slow wave $EH_{11}$ mode. For thick dielectric lining, the fields for the $EH_{11}$ mode are so strongly drawn into the liner that the wall currents also become large and the ohmic losses become excessive. Nevertheless, for $R=\beta/k$ less than about 1.005, corresponding to lining thicknesses of less than 0.0022 inches in FIG. 6, the ohmic wall losses are under 0.2 dB per foot. (A mode with characteristics almost identical to $EH_{11}$ appears for dielectric lining thicknesses slightly over one-half wavelength in the dielectric, or about 0.018 inches for the parameters of FIG. 6. Thick linings take much longer to deposit, however, and they are much more likely to have significant residual stresses.)

Referring next to FIG. 7, it is seen that the $TE_{11}$ mode (which becomes $EH_{11}$ in lined coaxial waveguide) is far removed from all the other $m=1$ modes. The same wide separation of $m=1$ modes is maintained over most of the range of dielectric lining thicknesses shown in FIG. 7. For the same reasons as in the circular waveguide (FIG. 6), a possible lining thickness for coupling is near 0.002 inches.

In the coaxial waveguide, other hybrid $EH_{m1}$ modes with $m\neq1$ are quite close to the $EH_{11}$ mode in propagation constant. Coupling between the $EH_{11}$ mode and such other hybrid modes may thus be a problem. Sources of coupling to such modes typically include geometric distortion of the outer or inner conductors, and deviation of the two coaxial conductors from concentricity.

Fortunately, the $EH_{11}$ mode is insensitive to the outer conductor. This is because since $EH_{11}$ is a surface wave, the fields decay away from the center conductor (whereon the dielectric lining is placed) and are small at the outer conductor. Hence, neither distortions in the outer conductor nor deviations from concentricity cause any significant coupling to other modes. This reduction of sensitivity to the outer conductor is a significant advantage of dielectric lined coaxial waveguide relative to unlined waveguide.

Non-circularity of the center (or inner) conductor remains as the only significant coupling mechanism for causing coupling between modes with different azimuthal indexes m. This coupling mechanism is advantageously controlled, e.g., by tapering the lining thickness, which is required for the desired coupling as discussed below.

Figure 8:
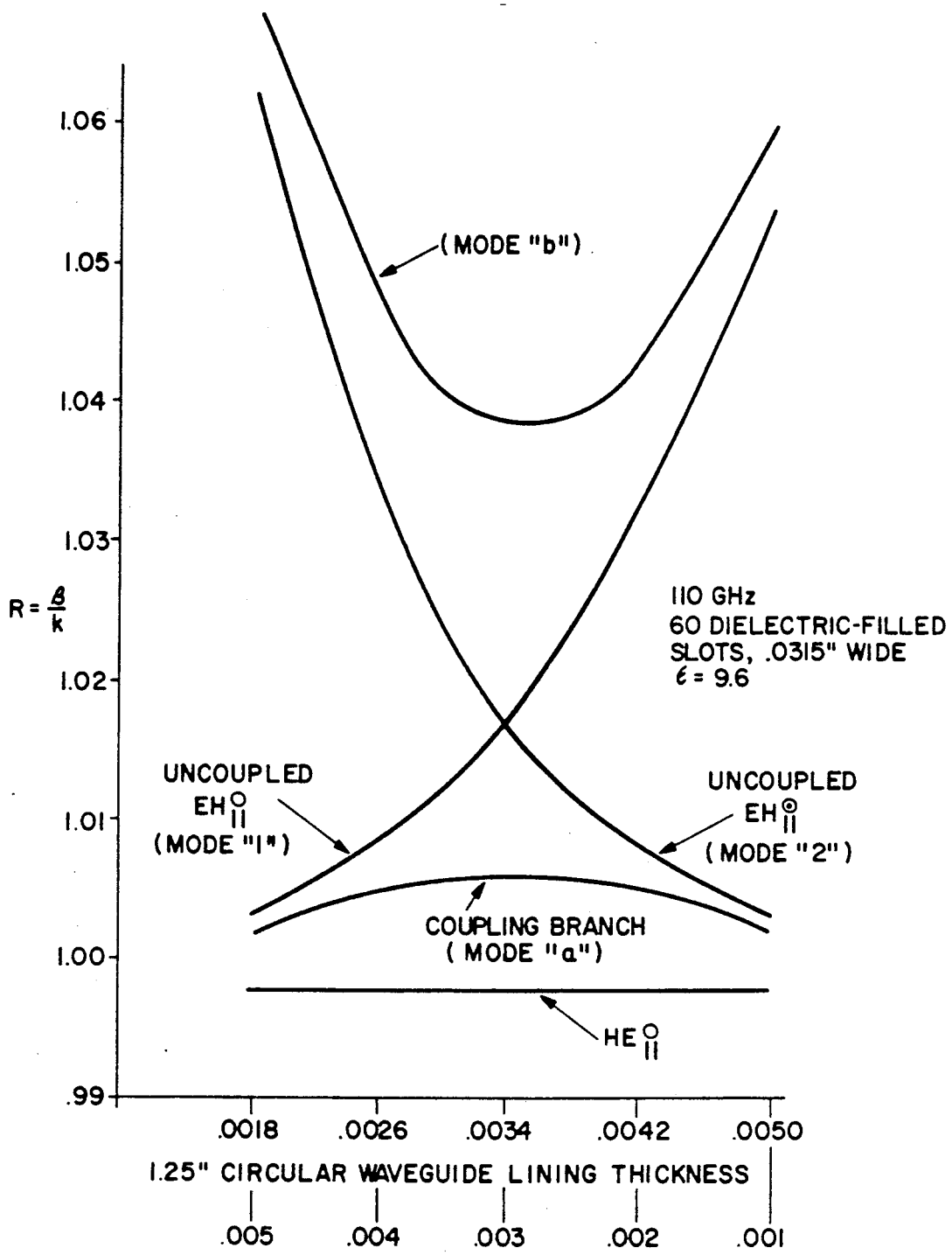
FIG. 8 is a graph illustrating the normalized propagation constants for the modes coupled by longitudinal dielectric-filled slots in the common wall of circular and coaxial waveguides having dielectric liners of varying thickness.

In order to achieve a desired coupling between one waveguide and another, the propagation constant of both waveguides should be made equal near the center of the coupling region. This allows the respective phase velocities of the propagating modes in each waveguide to intersect, as shown in FIG. 8.

Figure 9:
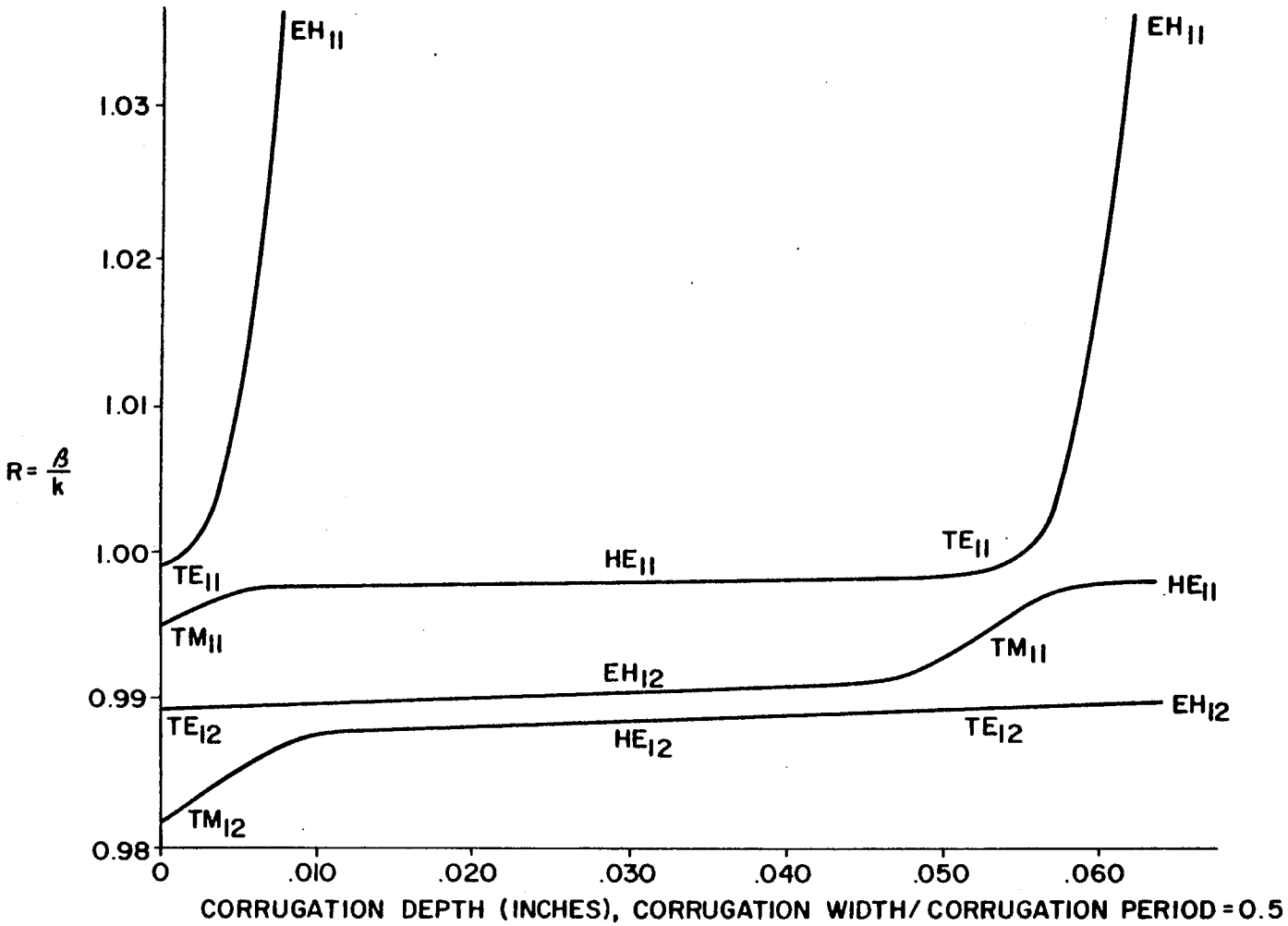
FIG. 9 is a graph similar to FIG. 6 for the case of corrugations of varying depth on the wall of circular waveguide.

The preferred input (or output) mode for the devices considered herein is the $HE_{11}$ mode in corrugated or dielectric lined circular waveguides. To convert to the $EH_{11}$ mode with a $\beta/k$ near 1.0, as at one end of the slotted coupling structure, a short section 17 of corrugated waveguide with a tapered corrugation depth may be used as shown, e.g., in FIG. 1A. As evident from the right side of FIG. 9, the corrugation depth should vary from near a quarter wavelength (to match with $HE_{11}$) to slightly over one-half wavelength (to match with $EH_{11}$). Note that one-half wavelength at 110 GHz corresponds to a corrugation depth of 0.054 inches. This taper is similar to the $HE_{11}$ to $TE_{11}$ converter in a corrugated waveguide, as described in M. Thumm, "Computer-Aided Analysis and Design of corrugated $TE_{11}$ to $HE_{11}$ Mode Converters in Highly Overmoded Waveguides," *Int'l J. Infrared and Millimeter Waves* 6, 577–597 (1985); and J. L. Doane, "Mode Converters for Generating the $HE_{11}$ (Gaussian-Line) Mode from $TE_{01}$ in a Circular Waveguide," *Int'l J. Electronics* 6, 573–585 (1982). The length of this taper should be long enough (sufficiently "adiabatic") to avoid scattering to the $EH_{12}$ branch (FIG. 9).

Such a converter may be made with over 99% theoretical efficiency in 14 inches of length for 1.25 inch diameter circular waveguides. Alternatively, the waveguide propagating $HE_{11}$ may be abruptly terminated in smooth wall waveguide. In this way, over 99% of the power is coupled to the $TE_{11}$ and $TM_{11}$ modes in the smooth waveguide. Tapering the corrugation depth from zero to the required small value (see the left side of FIG. 9) can transform this $TE_{11}/TM_{11}$ mixture to the desired $EH_{11}$ mode in a relatively short distance. A short length of smooth waveguide adjusts the relative phase of $TE_{11}$ and $TM_{11}$ to provide the optimum input to the corrugation depth taper.

Next, the slotted coupling region will be considered. In general, it can be shown that where M slots are equally spaced around the circumference of a common wall between overlapping unlined circular and coaxial waveguides, the $TE_{mn}$ modes in the circular waveguide are coupled to the $TE_{m'n'}$, modes in the coaxial waveguide, where $m'=m+pM$, $p=0, \pm1, \pm2, \ldots$. See U.S. patent application Ser. No. 07/462,377, filed 01/09/90, entitled "Compact Waveguide Converter Apparatus", which application, assigned to the same assignee as is the present application, is incorporated herein by reference. Hence, by choosing $p=0$ and $m=m'$, the value of M becomes rather arbitrary. When M is large, as is preferred to maximize the coupling, the orientation of the slots relative to the polarization of the modes is not critical. In this case, the polarization is preserved in coupling through the slots.

Thin longitudinal slots discriminate against coupling to TM modes. This is because, as long as the slots are thinner than one-half of the cutoff wavelength for each coupled mode, no azimuthal magnetic field can propagate through the slots, leaving the longitudinal magnetic field as the only component providing the coupling. Because TM modes have no such longitudinal component, no coupling to TM modes occurs.

Advantageously, longitudinal slots provide significant coupling only between modes whose phase velocities are almost identical. This is equivalent to requiring that the cutoff wavelengths of the microwave energy in the coupled waveguides be almost identical. The coupling is strongest when the wall thickness is approximately an odd multiple of one-quarter of the cutoff wavelength. In such instances, small impedance changes on one side of the common wall separating the coupled waveguides cause the largest impedance changes on the other side of the common wall.

Because hybrid modes in dielectric lined waveguides exhibit both TE and TM components, the coupling slots should be designed somewhat differently than when used in unlined waveguides. When the slots are thinner than one-half of the effective wavelength, they propagate a mode like the fundamental mode of parallel plate waveguides. In order to allow propagation of the lowest order TM mode in the slot, the slot width should be greater than one-half of the effective wavelength. The first higher-order TE mode in the slot is asymmetric about the center of the slot and is not excited significantly. If the slot is thinner than one wavelength, no other modes can be excited.

More particularly, the effective wavelength in the slot may be expressed as $2\pi/k_T$, where $k_T$ is the transverse wave number. The transverse wave number $k_T$ may be expressed as $$k_T = k\sqrt{\epsilon_r - R^2}\ , \tag{1}$$

where $\epsilon_r$ is the relative dielectric constant, and R is the longitudinal propagation constant normalized to free space, and may be defined, as noted above, as $$R = \beta/k. \tag{2}$$

In unlined waveguides, the effective slot wavelength is the same as the cutoff wavelength.

To maximize coupling, the wall thickness is chosen to be an odd multiple of the guide wavelength for the lowest order slot TM mode.

To determine an appropriate coupling slot length L, the waveguide structure (FIG. 1A) is considered as including both coupled waveguides and the coupling slots. At each cross section of this structure (FIG. 1B), there are normal modes with well-defined longitudinal propagation constants. Corresponding to the two independent modes outside of the slotted region (i.e., corresponding to the mode in the circular waveguide 12 referred to as "mode 1", and the mode in the coaxial waveguide 14, referred to as "mode 2"), there are two new normal modes, referred to as "mode a" and "mode b", in the slotted region. By analogy with the even-odd mode theory of directional couplers, the electric fields of mode a and mode b are approximately the sum and difference, respectively, of the electric fields of mode 1 and mode 2. When the phase velocities are constant along the slotted region, the coupling from the circular waveguide mode to the coaxial waveguide mode is complete only if mode a and mode b have a 180-degree relative phase shift over the slot length L. This condition may be expressed as:

$$\frac{L}{\lambda} = \frac{0.5}{(R_a - R_b)}\ , \tag{3}$$

where $\lambda$ is the free space wavelength.

In addition, for successful constant phase velocity coupling, the "a" and "b" normal modes must each have approximately half their power in the circular waveguide and half their power in the coaxial waveguide. This may not occur in the case of $EH_{11}$ mode coupling, because the average of the propagation constants for modes "a" and "b" is generally significantly larger than the propagation constant of the uncoupled modes "1" and "2". Also, a significant amount of power for at least one of the two new normal modes will be in the dielectric filled slots. A convenient, abrupt, termination of these slots at their ends is not consistent with such a power distribution. As a result, a third mode "c" confined mainly to the dielectric filled slots will likely be excited. This mode ("slot mode") will have closely spaced resonances determined by the length of the slots, and can cause large resonance losses.

In the tapered velocity coupler envisioned here, the dielectric lining thickness is varied throughout the slotted region on both the circular waveguide side and the coaxial waveguide side of the common conductor. At the ends of the slots, the thicknesses are adjusted so that the phase velocities (propagation constants) of the uncoupled modes are far apart. See FIG. 8. Then introduction of the slots does not initially affect the modes in either waveguide to any significant degree. Hence there does not have to be any energy in the slots near their ends. The efficiency of the tapered velocity coupling also does not depend significantly on the distribution of power between the waveguides at any one cross section.

To further suppress excitation of "slot modes" in the dielectric filled slots, the ends of these slots may be rounded over about a wavelength. The phase velocity of the slot modes is close to that of a plane wave in the dielectric, or over three times lower than free space for alumina. If the discontinuity in the ends of these slots is tapered over a free space wavelength, then the accumulated phase difference between the slot modes and volume modes, such as mode 1 and mode 2, will be over $4\pi$. The net excitation from rounded slot ends over this distance is then negligible.

The coupling efficiency of a tapered velocity coupler is given by $$\eta = 1 - \exp\left[\frac{-(\pi R_{r0})^2}{\delta R_r}\ \frac{L}{\lambda}\right]. \tag{4}$$

where $R_{r0}$ is the maximum difference ("splitting") of the normalized propagation constants $R_a$ and $R_b$ for the "a" and "b" normal modes, and $\delta R_r$ is the total change in the magnitude of $R_r = R_1 - R_2$ through the slotted coupling region. This change must be large enough that the "a" and "b" modes are virtually the same as the uncoupled modes "1" and "2" at the ends of the slots. The above expression for the efficiency applies when the variation in $R_1 - R_2$ is linear through the coupling region (see, for example, R. B. Smith, "Analytic Solutions for Linearly Tapered Directional Couplers," *J. Opt. Soc. Am.* 66: 882–892 (1976)). If $\delta R_r/L$ is interpreted as the gradient in $R_r$ at the location of maximum splitting, then the same expression for the efficiency as expressed above in Eq. (4) applies when the variation has a hyperbolic tangent form, even if the variation is nonsymmetric (see J. L. Doane, "Wave conversion in stratified media with hyperbolic-tangent nonuniformities," *J. Appl. Phys.* 45: 2748–2758 (1974)). Hence, the efficiency does not depend strongly on the exact variation. The tolerances on the dielectric thickness variations are therefore not overly stringent.

For the case shown in FIG. 8, the efficiency is over 99% for a linear taper in $R_r$ of 5 inches or longer. Tapered velocity coupling requires strong coupling for high efficiency, but this is possible with a large number of slots. The tapered velocity coupling is also relatively broadband.

The propagation constant of the closest mode, $HE_{11}$ in the circular waveguide, is perturbed by less than about 0.01% anywhere in the slotted region. Hence, the slots cause negligible coupling to $HE_{11}$ and other modes. The variation in the lining thickness can itself cause coupling from $EH_{11}$ to $HE_{11}$ and other modes, but this is also negligible in the 5 inch length required for high efficiency of the main coupling.

A more detailed description of the variations of the invention as shown in FIGS. 2-5 will next be presented. These variations are intended to be exemplary, and not limiting, of the various types of waveguide coupling, window, and/or converter structures that may be realized using the basic slotted dielectric-lined coupling structure of the present invention.

High Power Waveguide Vacuum Windows

Referring to FIG. 2, there is shown schematically a high power microwave window structure 40 that advantageously provides a double vacuum seal. The window structure 40 utilizes two back-to-back basic coupling sections 42 and 44, of the type described above in conjunction with FIGS. 1A and 1B. An input circular waveguide 46 couples input power through dielectric filled slots 48 to a coaxial waveguide 50. The wall of an inner conductor of the circular waveguide 46 comprises a common wall separating the coaxial waveguide 50 from the input circular waveguide 46 in a region of overlap. Similarly, the coaxial waveguide 50 couples power through dielectric filled slots 52 to an output circular waveguide 54. The inner conductor of the circular waveguide 46 also comprises a common wall separating the coaxial waveguide 50 from the output circular waveguide 54 in a region of overlap.

A dielectric lining 47 lines the inside of the input circular waveguide 46 in the region of overlap with the coaxial waveguide 50. Similarly, a dielectric lining 55 lines the inside of the output circular waveguide 54 in the region of overlap with the coaxial waveguide 50. Another dielectric lining 51 lines the outside of the inner conductor of the coaxial waveguide 50 along its entire length. Suitable absorbing material 53 is placed at both ends of the coaxial waveguide 50 to prevent undesired reflections. Further absorbing material 49 and 57 is placed in the ends of the input circular waveguide 46 and the output circular waveguide 54, respectively, for the same purpose. The absorbing material 49 and 57 may be any suitable lossy ceramic, such as silicon carbide. Cooling tubes may be utilized with the absorber material, as required.

The circular waveguide $HE_{11}$ mode is converted to the $EH_{11}$ mode in a corrugated waveguide region 41 of the input circular waveguide 46. The resulting circular $EH_{11}$ mode is coupled to a similar $EH_{11}$ coaxial waveguide mode in the first coupling section 42. After the coupling is complete, the second identical coupling section 44 couples the power back to the $HE_{11}$ mode via the $EH_{11}$ mode in a corrugated waveguide region 43 in the output circular waveguide 54. Since the coupling to and from the coaxial waveguide 50 is through the dielectric filled slots 48 and 52, there is actually a double vacuum barrier in this structure. Hence, this window is particularly useful near a plasma device that is producing tritium, or other radioactive substance. Not only does the window serve as a tritium barrier, but also the actual amount of tritium leakage through the dielectric may be conveniently monitored in the coaxial waveguide 50. Further, because of the double barrier, the pressure in the coaxial waveguide 50 may be different from that in the circular waveguides 46 and/or 54.

For the parameter values assumed in FIGS. 6 and 7, the cross sectional areas of the circular and coaxial waveguides are approximately the same. In order to obtain the coupling described above, the average thicknesses of the dielectric linings 47, 51 and 55 should also be approximately the same. Hence, the power densities in each waveguide are similar.

The total cross sectional area of the slots 48 and 52 is actually greater than the cross sectional area of the waveguides themselves. For example, for 60 slots of width 0.0315 inches, and length 5 inches, the total cross section is over 9 square inches. The total cross sectional area of the slots is thus much greater than that of the waveguide. Hence, the power density in the slots is low.

In order to fill the slots with a suitable dielectric, the dielectric material, e.g., alumina, is preferably fabricated in the form of preformed ribs that fit snugly into slots 48 or 52.. The slots 48 and 52 are machined in the metal common conductor (wall) separating the circular waveguides 46 and 54 from the coaxial waveguide 50, prior to having the preformed ribs inserted therein. Known processes, e.g. commercial CVD (chemical vapor deposition) processes, are then used to deposit the dielectric linings 47, 51 and 55. Such CVD processes not only deposit the dielectric linings on the appropriate wall of the waveguides, but also fill up any portion of the slots not filled by the preformed ribs and thus tightly seal the slots. Suitable grinding processes may then be used to produce the required tapers in the dielectric thicknesses.

The loss in each coupling region (i.e., in the region of the slots 48 and the region of the slots 52) may be estimated from the attenuation of the $EH_{11}$ mode in a circular waveguide with an alumina lining thickness that produces approximately the same value of normalized propagation constant R. For the case of FIG. 8, R is less than 1.005 on the branch carrying the power in the slotted region, and this corresponds to a dielectric thickness of about 0.0022 inches in an unslotted circular waveguide. Assuming a copper conductor (or copper coated molybdenum) having a surface resistance of 0.1 ohm at 110 GHz (which corresponds to a conductivity of about 40% poorer than ideal copper at 0 Hz), the $EH_{11}$ attenuation is then less than 2% in the 5 inch coupling region. The ohmic loss in two such coupling regions is thus on the order of about 4%. This is quite acceptable for most applications.

In addition, there will be a small amount of loss through the dielectric-filled slots and in the converters 41 and 43 converting from $HE_{11}$ to $EH_{11}$. The total ohmic attenuation for the window structure of FIG. 2 is thus on the order of about 5-6%, plus whatever attenuation is present in the coaxial waveguide 50 between the slots 48 and 52. This distance must be long enough to allow for the absorber loads 49 and 57 in the circular waveguide. The load 49 on the input waveguide 46 must absorb any unwanted modes incident on the window structure as well as any residual $HE_{11}$ power that is not converted to the coaxial region. The load 57 absorbs any power reflected from the destination in unwanted modes.

As shown in FIG. 10, heat created in the waveguide due to ohmic loss may be removed, as required, using cooling channels 60 that are fabricated between the slots in the common conductor 28. It is noted that FIG. 10 shows a cross sectional representation of the basic coupling structure 10 as in FIG. 1B, and uses the same reference numerals to represent like parts as are shown in FIG. 1B.

The ohmic loss might be reduced by making the circular waveguide diameter larger. The larger circumference corresponding to this larger size will also allow more coupling slots or more room for cooling channels.

The window structure 40 of FIG. 2 has low reflections as long as the absorber 49 has low reflections. The absorber 49 may be designed to have low reflections using conventional design techniques over a bandwidth determined by the absorber 49 itself. This characteristic represents a significant improvement over prior art windows that fill the cross section of the incident waveguide. When such prior art windows are used to couple power from a gyrotron, reflections of unwanted modes frequently cause undesirable mode hopping.

As required for the particular application of the window 40 shown in FIG. 2, the input circular waveguide 46 and/or the output circular waveguide 54 may be connected directly to a corrugated waveguide propagating the $HE_{11}$ mode.

Quasi-optic Gyrotron Output Coupler

A quasi-optic gyrotron is a possible alternative for generation of megawatt level power above 100 GHz. A quasi-optic gyrotron includes a gyrotron cavity bounded by two mirrors. One problem associated with such quasi-optic gyrotrons is coupling the output power to the $HE_{11}$ mode for low-loss transmission. Addition of a hole in the center of one cavity mirror is unsatisfactory because it adversely affects the fields in the cavity itself. Hence, at present, the only known way to couple the power out from a quasi-optic gyrotron is around the edge of an output mirror. See A. W. Fliflet, et al., "Design and Operating Characteristics of a CW Relevant Quasi-Optical Gyrotron with Variable Mirror Separation," *NRL Memorandum Report* 6459, Naval Research Laboratory, June 26, 1989.

The basic coupling apparatus of the present invention advantageously provides an efficient device for coupling power from a quasi-optic gyrotron to the $HE_{11}$ mode for low loss transmission. This is accomplished as shown schematically in FIG. 3. As seen in FIG. 3, an output coupler 64 is positioned adjacent a gyrotron cavity 66, bounded by mirrors 68 and 70, of a quasi-optic gyrotron. As with the basic coupling structure previously described, the coupler 64 includes a circular waveguide 72 that also functions as the inner conductor of an overlapping coaxial waveguide 74. The circular waveguide wall thus functions as a common wall 75 that separates the circular waveguide 72 from the coaxial waveguide 74 in the region of overlap. Dielectric-filled longitudinal slots 76 are placed in the common wall 75. A dielectric lining 78 is placed on the inside of the common wall 75. Another dielectric lining 80 is placed on the outside of the common wall. A corrugated region 73 having corrugations of varying depth is included in the circular waveguide 72 adjacent the overlap region 64, so as to convert between the $EH_{11}$ and $HE_{11}$ modes.

A suitable absorber 82 is placed in the end of the circular waveguide after the region of overlap so as to prevent any undesirable reflections. The inner conductor of the coaxial waveguide 74 (which is, in effect, an extension of the circular waveguide 72 in the region of overlap) is positioned adjacent to a backside of the mirror 70 of the gyrotron optical cavity 66. The dielectric lining 80 lines the outside of this outer conductor all the way up to the backside of the mirror 70. An outer conductor 88 of the coaxial waveguide 74 is preferably flared adjacent the mirror 70 so as to function as a horn in collecting any power that leaks around the edge of the mirror 70. Such flaring is not mandatory, but does assist in funneling the output power from the gyrotron cavity into the coaxial waveguide 74. Another absorber 86 is placed in the coaxial waveguide 74 so as to absorb any power not coupled through the slots 76 to the circular waveguide 72, thereby preventing undesirable reflections, and so as to also suppress undesired modes. The absorbers 82 and 86, as with all the absorbers referenced in FIGS. 2–5, may be any suitable lossy ceramic.

In operation, the diffraction of power or energy around the cavity mirror is linearly polarized. The flaring or tapering of the outer conductor 88 optimizes the coupling of the gyrotron output power into the $EH_{11}$ mode of the coaxial waveguide. That is, the outer conductor diameter taper serves to collect as much of the output power as possible, while gradually changing the diameter to an appropriate size for coupling to the circular waveguide. The thickness of the dielectric lining 80 is also tapered from an optimum value near the cavity mirror to the required value for the slotted region.

As seen in FIG. 7, as the lining thickness of a coaxial waveguide is increased, the $EH_{11}$ mode becomes more of a surface mode, and the fields decrease more rapidly away from the center conductor surface. This decay is approximately exponential. The fields in the gyrotron cavity also decay approximately exponentially from their axes since the cavity mode is approximately gaussian. Thus, it is possible to match these two exponential dependencies by suitable adjustment of the dielectric lining thickness on the coaxial center conductor. Hence, after the radiation is coupled from the gyrotron cavity to the coaxial waveguide, the dielectric thickness is tapered in the slotted coupling region in the same manner as for the window described above in connection with FIG. 2.

Figure 3A:
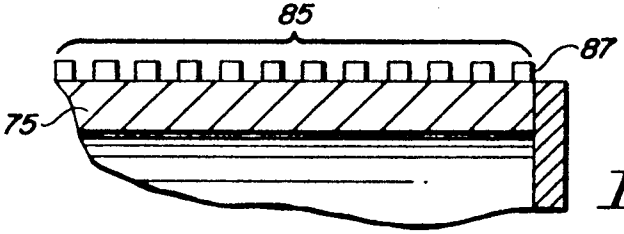
FIG. 3A shows an alternative construction for a portion of the output coupler of FIG. 3.

The above match may also be made with corrugations 87 of variable depth, in place of a varying dielectric thickness on the inner conductor 75 of the coaxial waveguide between the slotted coupling region and the quasi-optical gyrotron output mirror in the region 85, as shown in FIG. 3A.

The output from the circular waveguide 72 is matched to an appropriate corrugated waveguide $HE_{11}$ mode in the same manner as is used for the window described above in connection with FIG. 2.

Note that the output coupler 64 shown in FIG. 3 also serves as a vacuum window for a quasi-optical gyrotron when the tapered diameter input to the coupler is connected to the gyrotron structure near the cavity mirror 70.

Mode Converter for the Output of a Waveguide Cavity Gyrotron

Referring next to FIG. 4, a schematic representation of a mode converter 90 is shown. The converter 90 is specifically adapted to convert a whispering gallery mode or other mode, as might be available at the output of a gyrotron, to a circular $HE_{11}$ mode. Shown across the top of the figure are the various regions associated with the converter, as well as an indication of the particular mode that exists at the boundary of each region.

(Note, that a small circle, ⊖, by the mode symbol signifies a circular waveguide mode; whereas a small circle with a dot inside, ⊙, signifies a coaxial waveguide mode.)

Thus, as seen in FIG. 4, a circular waveguide mode, such as the $TE_{15,2}$ whispering gallery mode, enters the mode converter 90 by way of a circular waveguide 92. A first stage or region of the converter 90 gradually introduces a tapered center conductor 94 in the center of the waveguide 92, thereby converting the circular waveguide 92 to a first coaxial waveguide 95. This is identified in FIG. 4 as the "coaxial taper" region. At the end of the coaxial taper region, the waveguide mode has been converted to a coaxial $TE_{15,2}$ mode.

A second region of the converter 90, identified as the "multi-slot coupler", couples energy from the first coaxial waveguide 95 to a second coaxial waveguide 96. A conductor 97 functions as the inner conductor of the first coaxial waveguide 95 and the outer conductor of the coaxial waveguide 96. Longitudinal slots 98 in the conductor 97 couple power from the first coaxial waveguide 95 to the second coaxial waveguide 96, in a manner similar to that which is described in the previously referenced patent application, Ser. No. 07/462,377. A conductor 100 functions as the inner conductor of the second coaxial waveguide 96 in the multi-slot coupler region. A dielectric lining or corrugations on the outside of conductor 100 optimize the coupling in the region of the slots 98, as discussed below. At the end of the multi-slot coupler region, the mode is a coaxial $HE_{11}$ mode. (see FIG. 7)

A third region of the converter 90, identified as the "coaxial wall impedance taper" region, includes a dielectric lining 101 (or corrugations as discussed below) that gradually tapers up to a prescribed thickness at the beginning of a fourth region, identified as the "dielectric multi-slot coupler" region. At the beginning of the fourth region, the mode has thus been converted to a coaxial $EH_{11}$ mode. In the dielectric multi-slot coupler region, dielectric-filled slots 102 couple the power to the inside of the conductor 100, which conductor 100 thereafter functions as a circular waveguide through which the coupled output power may be delivered. A dielectric lining 103 is placed on the inside of the conductor 100 in the dielectric multi-slot coupler region. The thickness of this lining 103 is tapered throughout the dielectric multi-slot coupler region, just as in the case of the window described above in connection with FIG. 2. At the conclusion of the dielectric multi-slot coupler region, within the conductor 100, the mode of the propagating power has thus been converted to a circular waveguide $EH_{11}$ mode. A section 105 with corrugations of variable depth then converts this mode to a circular waveguide $HE_{11}$ mode, as discussed above in connection with the basic coupling and with the window of FIG. 2.

Hence, in operation, the converter 90 shown in FIG. 4 converts the input circular waveguide $TE_{15,2}$ (or other whispering gallery) mode to the circular waveguide $HE_{11}$ mode. It does this by converting the circular input waveguide to a first coaxial waveguide, coupling the power through multiple slots 98 to a second coaxial waveguide 96, and coupling the power from the second coaxial waveguide to the output circular waveguide 100 using dielectric filled slots and linings as described above in connection with the basic coupling structure of FIGS. 1A and 1B, or the window structure of FIG. 2.

In order to couple the input whispering gallery $TE_{15,2}$ circular waveguide mode to a suitable coaxial mode, it is necessary to introduce a coaxial waveguide inside of the input circular waveguide 92. Because the fields of the $TE_{15,2}$ mode are negligible near the center of the waveguide, the coaxial center conductor 94 may utilize a diameter that initially varies very rapidly. For example, if the input circular waveguide has a diameter of 3.5 inches, the center conductor of the first coaxial waveguide 95, may be 2.25 inches. This selection of waveguide sizes will place more current on the center conductor (roughly 50% more current) than on the outer conductor. Such a situation is desirable for coupling through the center conductor to the internal (second) coaxial waveguide 96. This selection of waveguide sizes further allows a taper from an initial center conductor diameter of, e.g., 1.5 inches, to the desired 2.25 inches in a length of 14 inches that provides less than 1% mode conversion and less than 1% ohmic loss. These values assume a copper conductor with a surface resistance of 0.1 ohms at 110 GHz.

The coaxial $TE_{15,2}$ mode is coupled to an $m=1$ mode in the interior coaxial waveguide 96 by introducing 16 (or 14) longitudinal slots in the common wall 97, and by designing the interior coaxial waveguide 96 to have the same propagation constant as exists in the input coaxial waveguide 95. Since the $TE_{15,2}$ mode is a high order mode, its propagation constant $\beta$ is considerably less than the $EH_{11}$ mode in the output region. For a 3.5 inch diameter outer conductor of the coaxial waveguide 95, and a 2.25 inch diameter inner conductor, $\beta$ for the $TE_{15,2}$ mode is 0.9774 k, where k is the propagation constant of free space. Fortunately, $\beta$ is very insensitive to the actual inner conductor diameter for diameters around 2.25 inches, increasing by only 0.05% if the inner conductor diameter is increased to 2.5 inches.

It can be shown that the propagation constants of the inner and outer coaxial waveguides can be made equal at 0.9774 k, thereby coupling the coaxial $TE_{15,2}$ mode to an interior coaxial $HE_{11}$ mode, by making the lining thickness on the center conductor of the inner coaxial waveguide to be about 0.0015 inches (see FIG. 7), and by selecting the outer conductor of the inner coaxial waveguide to have an inside diameter of 2.0 inches, and the inner conductor of the inner coaxial waveguide to have an outside diameter of 1.543 inches. The thickness of the common conductor 97 between the outer and inner coaxial waveguides is thus 0.125 inches. This is equal to a quarter of a cutoff wavelength for either mode (at 110 GHz). As indicated above, such a thickness maximizes the coupling.

When the width of the slots 98 is less than one-half of the cutoff wavelength, only modes with longitudinal magnetic field $B_z$ are coupled. With no dielectric in the slots of the common conductor 97, this condition is satisfied with slot widths of up to 0.25 inches. Typically, with 16 slots (at 110 GHz), the slot widths will be on the order of 0.040 inches.

A dielectric liner (or corrugations) is necessary on the center conductor of the inner coaxial waveguide in order to introduce a $B_z$ component to the coaxial $TM_{11}$ mode. This mode then becomes the coaxial $HE_{11}$ mode. At the same time, the propagation constant for $HE_{11}$ is moved away from that of the coaxial $EH_{12}$ mode, thus reducing unwanted coupling to that mode. See FIG. 7.

The length of the multi-slot coupler region may then be reasonably short, e.g., on the order of 2 to 3 inches, as determined by Eq. (3).

With the conversion made to the $HE_{11}$ mode having a propagation constant of 0.9774 k, a transition must next be made in the propagation constant to slightly over 1.0 k, in order to match the circular waveguide $EH_{11}$ mode in the output coupling region. This transition could be accomplished by introducing a dielectric lining thickness 101 on the center conductor 100. As seen in FIG. 7, a gradual thickness taper of from 0.0015 inches to 0.020 inches changes $HE_{11}$ mode to the required $EH_{11}$ mode. As the lining thickness reaches about a quarter wavelength in the dielectric (0.009 inches in FIG. 7), however, the $HE_{11}$ mode must actually "tunnel" through a gap (jump from curve 57 to curve 58). While such tunneling is possible with high efficiency, it is advantageous to avoid the relatively thick dielectric lining that follows.

Rather, it is preferred to use corrugations on the inner coaxial waveguide center conductor 100. As mentioned above, corrugations can substitute for a dielectric lining in the region of the slots 97. Then, in the coaxial wall impedance taper region (see FIG. 4), the depth of these corrugations is increased to slightly over one-half wavelength in order to produce the coaxial waveguide $EH_{11}$ mode. The corrugations on conductor 100 can then be terminated and replaced by the relatively thin dielectric liner as required for the dielectric multi-slot coupler.

This corrugation depth taper is designed in a manner similar to the output circular waveguide taper, using techniques described in Thumm (1985) and/or Doane (1982), supra. In the corrugated coaxial waveguide there is no need for tunneling, but otherwise the modes are well separated just as in FIG. 7. Hence, the depth taper may be quite short.

Mode Converter for Use Inside a Whispering Gallery Mode Gyrotron

The mode converter described above in connection with FIG. 4 may be used with only slight modification inside of a gyrotron, as shown schematically in FIG. 5. As seen in FIG. 5, an internal mode converter 110 takes power from a gyrotron cavity through an input circular waveguide 112, which waveguide is converted to an outer coaxial waveguide (comprising outer conductor 114 and inner conductor 116), through longitudinal slots 115 to an inner coaxial waveguide (comprising outer conductor 116 and inner conductor 118), and through dielectric filled longitudinal slots 120 to an output circular waveguide (comprising conductor 118). A suitable dielectric lining is placed on both sides of the conductor 118 in the dielectric multi-slot coupler region, as described above.

As with the mode converter described above in connection with FIG. 4, the mode of the input power is a whispering gallery or other gyrotron mode. The mode of the output power is $HE_{11}$.

The only significant difference from the mode converter of FIG. 4 and that of FIG. 5 is the change in the input coaxial taper. That is, in FIG. 5, the input circular waveguide conductor 112 flairs or tapers from a first diameter $d_{cir}$ to a second diameter $d_{coax}$. This is done because when the mode converter is used inside a gyrotron, the input diameter $d_{cir}$ must be close to that of the cavity output, which is typically much smaller than the collector output.

The internal mode converter 110 advantageously allows convenient separation of an electron beam 124 from the microwave beam (power). The distance between the inner conductor 116 and the outer conductor 114 of the outer coaxial waveguide in the first coupling region is more than adequate to allow the electron beam to pass. A typical design value for this conductor spacing is 0.625 inches.

After the separation from the microwave beam, the electron beam 124 is collected in a collector structure 126 that does not have to preserve microwave mode purity. Advantageously, the collector diameter is tapered rapidly, e.g., to a final diameter, $d_{col}$, that is relatively large. Using a large collector diameter with a correspondingly large surface area reduces the wall loading and the likelihood of hot spots that could cause collector failure.

As a further advantage of the mode converter 110, the dielectric-filled slot coupling region, i.e., the region in the vicinity of the slots 120, serves as a natural vacuum window. The circular waveguide output propagating the $HE_{11}$ mode will typically be evacuated, or at least at a different pressure from that of the gyrotron interior. Advantageously, the maximum pressure to avoid breakdown in the output waveguide (formed from the conductor 118) is much larger than the maximum pressure to avoid damage to the electron gun in the gyrotron.

As discussed above, a vacuum window formed in this manner (using dielectric-filled slots as described herein) has inherently low reflections over a large bandwidth. The only limitations result from reflections from the interior loads. Advantageously, these reflections can be controlled using appropriate absorbers, or equivalent, within the coupled waveguides. This characteristic thus eliminates, or significantly minimizes, the tendency of the gyrotron to hop to an unwanted mode that happens to have a large reflection.

From the above descriptions, it is thus seen that the present invention provides, in accordance with one embodiment, a circular-to-coaxial waveguide coupling apparatus the efficiently transfers microwave energy or power between circular and coaxial waveguides at low ohmic loss and low spurious mode generation. Advantageously, the apparatus converts and controls the mode in which the microwave energy or power propagates, at least in part, by controlling the thickness of a dielectric lining on both sides of the common wall separating the circular and coaxial waveguides.

As is further evident from the above description, the coupling apparatus of the present invention not only couples microwave energy or power from an input waveguide to an output waveguide, but it does so while converting the output power to an appropriate mode, e.g., the $HE_{11}$ mode. Thus, the apparatus functions as a mode converter. Further, the coupling and mode conversion occurs while physically sealing the two coupled waveguides from each other. Hence, the apparatus also functions as a microwave window, thereby allowing desired conditions, e.g., the presence of certain gases or pressure, evacuation, etc., in both waveguides to be independently maintained.

As also apparent from the above description, the coupling, converting, and windowing apparatus of the present invention is relatively easy and inexpensive to manufacture, and lends itself to a wide variety of high power microwave coupling, windowing and mode conversion applications, including coupling high power microwave energy from a gyrotron, with the apparatus being located external or internal to the gyrotron.

While the invention herein disclosed has been described by means of specific embodiments and applications thereof, numerous modifications and variations could be made thereto by those skilled in the art without departing from the scope of the invention set forth in the claims.

What is claimed is:

1. Waveguide coupling apparatus for converting microwave energy in a circular waveguide propagating the $HE_{11}$ mode to a suitable coaxial waveguide mode, each of said waveguide modes having a phase velocity associated therewith, said apparatus comprising:

a circular waveguide;

a coaxial waveguide concentric with said circular waveguide and overlapping a portion of said circular waveguide, a common wall separating said circular waveguide from said coaxial waveguide, said common wall comprising an outer wall of said circular waveguide and an inner wall of said coaxial waveguide in the portion of overlap;

means for coupling the microwave energy in said circular waveguide to a corresponding mode in the coaxial waveguide, said coupling means including an array of N equally spaced axial slots placed in said common wall, where N is an integer, said slots being filled with a dielectric;

a dielectric lining on both sides of the common wall in the portion of overlap, the respective thicknesses of said dielectric lining on at least one side of the common wall being tapered to optimize the coupling and to cause an intersection of the phase velocities of the microwave energy propagating the respective waveguide modes in said circular and coaxial waveguides.

2. The waveguide coupling apparatus as set forth in claim 1 further including conversion means for converting the microwave energy from the $HE_{11}$ mode in said circular waveguide to an intermediate mode suitable for coupling through said axial slots, said means including a phase shifting section of smooth waveguide followed by a section of corrugated waveguide, said corrugated waveguide having corrugations that increase in depth from zero to a first depth, said first depth being selected to match the intermediate mode at one end of said N equally spaced axial slots.

3. The waveguide coupling apparatus as set forth in claim 1 further including conversion means for converting the microwave energy from the $HE_{11}$ mode in said circular waveguide to an intermediate mode suitable for coupling through said axial slots, said means including corrugations introduced in said circular waveguide, said corrugations having a depth that increases from approximately one-quarter wavelength to match the $HE_{11}$ mode to approximately one-half wavelength to match the intermediate mode at one end of said N equally spaced axial slots.

4. The waveguide coupling apparatus as set forth in claim 1 wherein said axial slots include a taper in the width thereof at the beginning and end of each slot.

5. The waveguide coupling apparatus as set forth in claim 1 wherein the thickness of the dielectric lining is tapered on both sides of said slotted common wall in a way that causes the phase velocities of the modes in said circular and coaxial waveguides to intersect.

6. Waveguide window apparatus comprising:

first waveguide coupling means for coupling microwave energy from a first circular waveguide to a coaxial waveguide;

second waveguide coupling means for coupling microwave energy from said coaxial waveguide to a second circular waveguide;

pressure tight sealing means for: (a) sealing said first circular waveguide from said coaxial waveguide in the region of said first waveguide coupling means, (b) sealing said second circular waveguide from said coaxial waveguide in the region of said second waveguide coupling means, (c) sealing said coaxial waveguide from its surrounding environment and (d) sealing said first circular waveguide from said second circular waveguide; and absorbing means positioned within said first and second circular waveguides and said coaxial waveguide for: (a) preventing reflections of any microwave energy incident upon said first and second waveguide coupling means in unwanted modes, and (b) avoiding reflections of microwave energy not completely coupled through said first and second waveguide coupling means.

7. The waveguide window apparatus as set forth in claim 6 wherein said coaxial waveguide is concentric with and overlaps a first end portion of said first circular waveguide in a first region of overlap, and is concentric with and overlaps a first end portion of said second circular waveguide in a second region of overlap, a first common wall separating said first circular waveguide from said coaxial waveguide in the first region of overlap, and a second common wall separating said second circular waveguide from said coaxial waveguide in the second region of overlap, said first and second common walls in the first and second regions of overlap being respectively lined with first and second dielectric linings on both sides of the common wall.

8. The waveguide window apparatus as set forth in claim 7 wherein said first coupling means comprises a first array of N equally spaced axial slots placed in said first common wall in the first region of overlap, where N is an integer, and wherein said second coupling means comprises a second array of M equally spaced axial slots placed in said second common wall in the second region of overlap, where M is an integer.

9. The waveguide window apparatus as set forth in claim 8 wherein said sealing means includes a dielectric that fills said axial slots placed in said first and second common walls.

10. The waveguide window apparatus as set forth in claim 9 wherein said first and second dielectric linings have tapers of respective varying thicknesses on each side of the respective common walls, the thickness tapers of said dielectric linings being chosen to optimize the coupling and to cause an intersection of the phase velocities of the microwave energy propagating in the respective waveguide modes in said circular and coaxial waveguides.

11. The waveguide window apparatus as set forth in claim 9 wherein an inner wall of said coaxial waveguide comprises said first and second common wall in the first and second regions of overlap, whereby said first and second circular waveguides have a diameter equal to the inside diameter of an inner conductor of said coaxial waveguide.

12. The waveguide window apparatus as set forth in claim 9 wherein an inner wall of said coaxial waveguide comprises said first common wall in the first region of overlap, and wherein an outer wall of said coaxial waveguide comprises said second common wall in the second region of overlap, whereby said first circular waveguide has a diameter smaller than said second circular waveguide.

13. Output coupler apparatus for coupling microwave energy out of a quasi-optical microwave resonator said microwave resonator including mirrors aligned to reflect resonating microwave energy therebetween, a first mirror having a diameter D, said coupler apparatus, comprising:

a circular waveguide having a coupling end and an output end, said circular waveguide being adapted to propagate microwave energy in the $HE_{11}$ mode, said circular waveguide further having an outside diameter approximately equal to the diameter D of said first mirror;

a coaxial waveguide concentric with said circular waveguide and overlapping a portion of said circular waveguide proximate said coupling end, a common wall separating said circular waveguide from said coaxial waveguide, said common wall comprising an outer wall of said circular waveguide and an inner wall of said coaxial waveguide in the portion of overlap, the diameter D of said first mirror approximately matching the outside diameter of said common wall, said common wall being attached at one end to a back side of said first mirror, whereby a portion of the microwave energy resonating in said quasi-optical microwave resonator escapes over said first mirror and into said coaxial waveguide;

means for coupling the microwave energy propagating in said coaxial waveguide to the coupling end of said circular waveguide, said coupling means including an array of N equally spaced axial slots placed in said common wall in the portion of overlap, where N is an integer, said slots being filled with a dielectric; and a dielectric lining on both sides of the common wall in the portion of overlap.

14. The output coupler apparatus as set forth in claim 13 further including:

first absorbing means within said coaxial waveguide positioned nearest the output end of said circular waveguide and farthest from said quasi-optical microwave resonator for preventing reflections of microwave energy back towards said quasi-optical microwave resonator; and second absorbing means within said circular waveguide nearest said coupling end for preventing reflections of unwanted microwave modes.

15. The output coupler apparatus as set forth in claim 14 wherein said dielectric lining on the coaxial waveguide side of said common wall has a taper in its thickness intermediate said axial slots and said quasi-optical microwave resonator, said taper optimizing the matching of microwave energy diffracted around said quasi-optical microwave resonator into said coaxial waveguide.

16. The output coupler apparatus as set forth in claim 14 further including corrugations of variable depth placed on the coaxial side of said common wall intermediate said axial slots and said quasi-optical microwave resonator, the depth of said corrugations being selected to optimize the matching of microwave energy diffracted around said quasi-optical microwave resonator into said coaxial waveguide.

17. The output coupler apparatus as set forth in claim 15 further including means for optimizing the coupling of the microwave energy into said coaxial waveguide from said quasi-optical microwave resonator.

18. The output coupler apparatus as set forth in claim 17 wherein said optimizing means comprises an outer wall of said coaxial waveguide that tapers to a larger diameter proximate said quasi-optical microwave resonator.

19. The output coupler apparatus as set forth in claim 13 further including window means for physically sealing and separating one side of said common wall from the other, said window means including the dielectric filled slots of said common wall.

20. The output coupler apparatus as set forth in claim 19 wherein said quasi-optical microwave resonator comprises part of a quasi-optical gyrotron.

21. Waveguide mode converter apparatus comprising:

(a) a circular waveguide having a coupling end and an output end, said circular waveguide being adapted to propagate microwave energy in a first waveguide mode;

(b) a first coaxial waveguide concentric with said circular waveguide and overlapping a first portion of said circular waveguide proximate said coupling end, a first common wall separating said circular waveguide from said first coaxial waveguide, said first common wall comprising an outer wall of said circular waveguide and an inner wall of said first coaxial waveguide in the first portion of overlap;

(c) first coupling means for coupling microwave energy propagating in said first coaxial waveguide to a first waveguide mode in said circular waveguide, said first coupling means including an array of N equally spaced axial slots placed in said first common wall in the first portion of overlap, where N is an integer;

(d) a coaxial waveguide extension connected to said first coaxial waveguide, an inner wall of said coaxial waveguide extension comprising an extension of said first common wall;

(e) a second coaxial waveguide overlapping a second portion of said coaxial waveguide extension, a second common wall separating said coaxial waveguide extension from said second coaxial waveguide, said second common wall comprising an outer wall of said coaxial waveguide extension and an inner wall of said second coaxial waveguide;

(f) second coupling means for coupling microwave energy propagating in a second waveguide mode in said second coaxial waveguide to said first coaxial waveguide, said second coupling means including an array of M equally spaced axial slots placed in said second common wall in the second portion of overlap, where M is an integer; and (g) means for separating TE and TM modes of microwave energy propagating through said mode converter apparatus;

whereby microwave energy propagating in said second waveguide mode in said second coaxial waveguide is coupled to propagate in said first waveguide mode in said circular waveguide.

22. Waveguide mode converter apparatus as set forth in claim 21 wherein said mode separating means comprises a dielectric lining on both sides of the common wall in the first portion of overlap, and corrugations on the inner wall of said first coaxial waveguide in the second portion of overlap.

23. Waveguide mode converter apparatus as set forth in claim 22 further including a dielectric lining on the inside wall of said coaxial waveguide extension intermediate said first and second portions of overlap.

24. Waveguide mode converter apparatus as set forth in claim 22 further including corrugations on the inside wall of said coaxial waveguide extension intermediate said first and second portions of overlap.

25. Waveguide mode converter apparatus as set forth in claim 22 wherein each of said N axial slots are filled with a dielectric.

26. Waveguide mode converter apparatus as set forth in claim 25 further including mode suppression means for suppressing unwanted modes in said first and second coupling means.

27. Waveguide mode converter apparatus as set forth in claim 26 wherein said mode suppression means comprises a taper in the width of said N or M axial slots proximate the beginning and end of the first or second portions of overlap, respectively.

28. Waveguide mode converter apparatus as set forth in claim 26 further including means for changing the propagation constant of microwave energy propagating through said mode converter apparatus.

29. Waveguide mode converter apparatus as set forth in claim 28 wherein said propagation constant changing means comprises a taper in the thickness of the dielectric lining on the inside wall of said coaxial waveguide extension in a region of said coaxial waveguide extension where there are no axial slots.

30. Waveguide mode converter apparatus as set forth in claim 28 wherein said propagation constant changing means comprises a taper in the depth of corrugations on the inside wall of said coaxial waveguide extension in a region of said coaxial waveguide extension where there are no axial slots.

31. Waveguide mode converter apparatus as set forth in claim 28 further including connecting means for connecting said second coaxial waveguide to a second circular waveguide.

32. Waveguide mode converter apparatus as set forth in claim 31 wherein said connecting means comprises a taper in the diameter of a center conductor of said second coaxial waveguide from its value in the second portion of overlap to zero.

33. Waveguide mode converter apparatus as set forth in claim 31 wherein said connecting means includes third coupling means between said second coaxial waveguide and said second circular waveguide, said second coaxial waveguide being positioned concentric with said second circular waveguide and overlapping a third portion of said second circular waveguide proximate a coupling end of said second circular waveguide, a third common wall separating said second circular waveguide from said second coaxial waveguide, said third coupling means comprising an array of L equally spaced axial slots placed in said third common wall in the third portion of overlap, where L is an integer.

34. Waveguide mode converter apparatus as set forth in claim 32 wherein said second circular waveguide is coupled to a gyrotron, and wherein microwave energy propagating in said second circular waveguide propagates in a third waveguide mode.

35. Waveguide mode converter apparatus as set forth in claim 34 wherein said third waveguide mode comprises an output mode of said gyrotron.

36. Waveguide mode converter apparatus as set forth in claim 33 wherein said second circular waveguide is coupled to a gyrotron, and wherein microwave energy propagating in said second circular waveguide propagates in a third waveguide mode.

37. Waveguide mode converter apparatus as set forth in claim 36 wherein said third waveguide mode comprises an output mode of said gyrotron.

38. Waveguide mode converter apparatus as set forth in claim 32 wherein said second circular waveguide is located inside a gyrotron, the dielectric-filled slots of said second coupling means comprising an output window of said gyrotron, an electron beam of said gyrotron being separated from the microwave energy by said second coupling means.

39. Waveguide mode converter apparatus as set forth in claim 38 wherein the first waveguide mode of the microwave energy propagating in said circular waveguide comprises the $HE_{11}$ mode.

* * * * *

UNITED STATES PATENT AND TRADEMARK OFFICE

CERTIFICATE OF CORRECTION

PATENT NO. : 5,043,629

DATED : August 27, 1991

INVENTOR(S) : John L. Doane

It is certified that error appears in the above-identified patent and that said Letters Patent is hereby corrected as shown below:

Column 11, line 42, after "12" insert a comma.

Column 12, line 20, after "any" insert --significant--.

Column 17, line 1, change "⊙" to --O--.

Column 17, line 3, change "O" to --o--.

Signed and Sealed this

Twelfth Day of January, 1993

*Attest:*

*Attesting Officer*

DOUGLAS B. COMER

*Acting Commissioner of Patents and Trademarks*